US009612569B2

(12) United States Patent
Fukamachi

(10) Patent No.: US 9,612,569 B2
(45) Date of Patent: Apr. 4, 2017

(54) CARTRIDGE WITH MULTIPLE ROTARY MEMBERS

(71) Applicant: Brother Kogyo Kabushiki Kaisha, Nagoya-shi, Aichi-ken (JP)

(72) Inventor: Yasuo Fukamachi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/670,502

(22) Filed: Mar. 27, 2015

(65) Prior Publication Data

US 2015/0277353 A1 Oct. 1, 2015

(30) Foreign Application Priority Data

Mar. 31, 2014 (JP) ..... 2014-074728

(51) Int. Cl.

| | |
|---|---|
| ***G03G 15/04*** | (2006.01) |
| ***G03G 21/16*** | (2006.01) |
| ***G03G 15/08*** | (2006.01) |
| ***G03G 21/18*** | (2006.01) |

(52) U.S. Cl.

CPC ..... *G03G 21/1647* (2013.01); *G03G 15/0865* (2013.01); *G03G 21/1857* (2013.01); *G03G 21/1896* (2013.01); *G03G 2221/1657* (2013.01)

(58) Field of Classification Search

CPC ..... G03G 21/1647
USPC ..... 399/12, 110, 111
See application file for complete search history.

(56) References Cited

U.S. PATENT DOCUMENTS

| | | | |
|---|---|---|---|
| 4,974,020 | A | 11/1990 | Takamatsu et al. |
| 5,053,816 | A | 10/1991 | Takahashi |
| 5,489,976 | A | 2/1996 | Ichikawa |
| 5,495,323 | A | 2/1996 | Meetze, Jr. |
| 5,495,327 | A | 2/1996 | Inomata |
| 5,640,651 | A | 6/1997 | Katoh et al. |
| 5,649,264 | A | 7/1997 | Domon et al. |

(Continued)

FOREIGN PATENT DOCUMENTS

| | | | |
|---|---|---|---|
| AU | 2010281279 | B2 | 2/2014 |
| CN | 1445624 | A | 10/2003 |

(Continued)

OTHER PUBLICATIONS

Aug. 21, 2015 (EP) Extended EP Search Report—App. No. 15161258.7.

(Continued)

*Primary Examiner* — Quana M Grainger
(74) *Attorney, Agent, or Firm* — Banner & Witcoff, Ltd.

(57) ABSTRACT

A cartridge including a housing configured to accommodate therein developer, a driving receiving part configured to receive a driving force, a transmission member configured to rotate by receiving a driving force from the driving receiving part, a first rotary member configured to rotate by abutting on the transmission member and receiving a driving force from the transmission member, a second rotary member configured to abut on the transmission member by receiving a driving force from the first rotary member, and rotate by abutting on the transmission member and receiving a driving force from the transmission member, and a detected part configured to move in accordance with the rotation of the second rotary member.

20 Claims, 18 Drawing Sheets

(56) References Cited

U.S. PATENT DOCUMENTS 5,970,293 A 10/1999 Huang
6,088,561 A 7/2000 Kawamura et al.
6,154,619 A 11/2000 Boockholdt et al.
6,714,224 B2 3/2004 Yamanaka et al.
6,792,217 B2 9/2004 Nishino et al.
6,823,160 B2 11/2004 Okabe
6,829,465 B2 12/2004 Yamanaka et al.
6,903,759 B2 6/2005 Yamanaka et al.
6,909,866 B2 6/2005 Kawai
6,920,303 B2 7/2005 Yamanaka et al.
7,116,919 B2 10/2006 Ishii
7,130,551 B2 10/2006 Kobayashi
7,418,214 B2 8/2008 Yoshida et al.
7,463,834 B2 12/2008 Takagi et al.
7,509,075 B2 3/2009 Hayakawa
7,512,347 B2 3/2009 Suzuki et al.
7,536,117 B2 5/2009 Kishi
7,613,414 B2 11/2009 Kamimura
7,643,777 B2 1/2010 Matsumoto et al.
7,756,426 B2 7/2010 Kamimura
7,933,536 B2 4/2011 Ogawa
7,953,330 B2 5/2011 Ishikawa
8,010,026 B2 8/2011 Kobayashi et al.
RE42,796 E 10/2011 Ishii
8,090,272 B2 1/2012 Ishikawa
8,099,025 B2 1/2012 Ishikake
8,126,366 B2 2/2012 Hattori
8,417,130 B2 4/2013 Hashimoto
8,463,145 B2 6/2013 Ukai et al.
8,583,009 B2 11/2013 Takagi
8,600,244 B2 12/2013 Hashimoto
8,620,180 B2 12/2013 Shiraki et al.
8,666,293 B2 3/2014 Mushika et al.
8,744,288 B2 6/2014 Shinoya et al.
8,761,643 B2 6/2014 Mushika et al.
8,849,133 B2 9/2014 Itabashi et al.
8,867,932 B2 10/2014 Ukai et al.
8,948,617 B2 2/2015 Shiraki et al.
8,948,661 B2 2/2015 Mushika et al.
9,195,207 B2 11/2015 Itabashi
9,207,567 B2 12/2015 Mushika et al.
2003/0185579 A1 10/2003 Nishino et al.
2003/0185594 A1 10/2003 Okabe
2003/0215265 A1 11/2003 Kawai
2006/0034625 A1 2/2006 Kajikawa
2006/0104670 A1 5/2006 Nishitani et al.
2006/0165423 A1 7/2006 Nishitani et al.
2006/0171737 A1 8/2006 Nishimura et al.
2006/0193643 A1 8/2006 Takagi et al.
2006/0193646 A1 8/2006 Suzuki et al.
2006/0245787 A1 11/2006 Ito et al.
2007/0031158 A1 2/2007 Kamimura
2007/0041747 A1 2/2007 Kim et al.
2007/0059018 A1 3/2007 Tokuda
2007/0059038 A1 3/2007 Shiraki
2007/0077101 A1 4/2007 Tamura et al.
2007/0122165 A1 5/2007 Igarashi et al.
2007/0140709 A1 6/2007 Yoshida et al.
2007/0140725 A1 6/2007 Kamimura
2007/0253748 A1 11/2007 Matsumoto et al.
2008/0080904 A1 4/2008 Murayama et al.
2008/0205911 A1 8/2008 Ishikawa et al.
2008/0205928 A1 8/2008 Ishikawa
2008/0205931 A1 8/2008 Ishikawa
2008/0223173 A1 9/2008 Ishikawa
2008/0317509 A1 12/2008 Mori
2009/0000423 A1 1/2009 Ishikawa et al.
2009/0052911 A1 2/2009 Richey et al.
2009/0084210 A1 4/2009 Tsukada et al.
2009/0169247 A1 7/2009 Hattori
2009/0257782 A1 10/2009 Ishikake
2009/0269085 A1 10/2009 Ukai
2009/0269086 A1 10/2009 Mikuni
2009/0285604 A1 11/2009 Nakajima
2009/0297226 A1 12/2009 Nagashima et al.
2010/0054763 A1 3/2010 Tomiyori et al.
2010/0209144 A1 8/2010 Nieda
2011/0023368 A1 2/2011 Mizutani et al.
2011/0038649 A1 2/2011 Miyabe et al.
2011/0081163 A1 4/2011 Lee
2011/0123231 A1 5/2011 Ozawa et al.
2011/0236062 A1 9/2011 Takagi
2011/0236065 A1 9/2011 Takagi
2011/0236066 A1 9/2011 Takagi
2011/0243578 A1* 10/2011 Ukai ..... G03G 21/1896 399/12
2012/0014713 A1 1/2012 Murakami et al.
2012/0051795 A1 3/2012 Mushika et al.
2012/0057905 A1 3/2012 Itabashi
2012/0134688 A1 5/2012 Hashimoto
2012/0148297 A1 6/2012 Peng et al.
2012/0177398 A1 7/2012 Takigawa
2012/0243882 A1 9/2012 Carot
2012/0251165 A1 10/2012 Mushika et al.
2012/0251216 A1 10/2012 Mushika
2012/0321345 A1 12/2012 Shinoya et al.
2013/0051813 A1 2/2013 Itabashi et al.
2013/0051814 A1 2/2013 Itabashi et al.
2013/0051815 A1 2/2013 Itabashi et al.
2013/0051816 A1 2/2013 Itabashi
2013/0051833 A1 2/2013 Itabashi et al.
2013/0084083 A1 4/2013 Itabashi et al.
2013/0136460 A1 5/2013 Shiraki et al.
2013/0170844 A1 7/2013 Itabashi
2013/0170845 A1 7/2013 Itabashi
2013/0259528 A1 10/2013 Yamamoto
2013/0272724 A1 10/2013 Ukai et al.
2014/0020489 A1 1/2014 Nozaki et al.
2014/0086638 A1 3/2014 Sato
2014/0169835 A1 6/2014 Nakajima
2014/0219690 A1 8/2014 Li et al.
2014/0294403 A1 10/2014 Shimizu
2014/0341617 A1 11/2014 Mushika et al.
2014/0363189 A1 12/2014 Hashimoto et al.
2014/0376968 A1 12/2014 Yamamoto et al.
2015/0000443 A1 1/2015 Shimizu
2015/0003844 A1 1/2015 Ukai et al.
2015/0005134 A1 1/2015 Shimizu
2015/0010334 A1 1/2015 Nakajima
2015/0037071 A1 2/2015 Yamamoto
2015/0043944 A1 2/2015 Yamamoto
2015/0104222 A1 4/2015 Mushika et al.
2015/0117873 A1 4/2015 Mori et al.
2015/0117906 A1 4/2015 Mori
2015/0153675 A1 6/2015 Itabashi et al.

FOREIGN PATENT DOCUMENTS

CN 1828447 A 9/2006
CN 1288515 C 12/2006
CN 2884266 Y 3/2007
CN 1983078 A 6/2007
CN 101063855 A 10/2007
CN 200962188 Y 10/2007
CN 101256379 A 9/2008
CN 101295157 A 10/2008
CN 201170840 Y 12/2008
CN 100476636 C 4/2009
CN 201222170 Y 4/2009
CN 101625537 B 1/2010
CN 201402371 Y 2/2010
CN 201464807 U 5/2010
CN 201489284 U 5/2010
CN 202102251 U 1/2012
CN 202472249 U 10/2012
CN 102799090 A 11/2012
CN 202649679 U 1/2013
CN 203673223 U 6/2014
EP 0838733 A2 4/1998
EP 1696278 A2 8/2006
EP 1696278 A3 8/2006
EP 1965268 A1 9/2008
EP 1965274 A2 9/2008
EP 1995644 A2 11/2008

(56) References Cited

FOREIGN PATENT DOCUMENTS

| | | | |
|---|---|---|---|
| EP | 2093619 | A1 | 8/2009 |
| EP | 2369422 | A1 | 9/2011 |
| EP | 2378378 | A2 | 10/2011 |
| EP | 2463723 | A1 | 6/2012 |
| EP | 2463723 | A4 | 6/2012 |
| EP | 2574991 | A2 | 4/2013 |
| EP | 2574992 | A2 | 4/2013 |
| EP | 2574993 | A2 | 4/2013 |
| HK | 1090991 | A1 | 11/2009 |
| JP | S5323696 | | 2/1978 |
| JP | 36183570 | A | 4/1986 |
| JP | S63-118042 | U | 7/1988 |
| JP | H01205175 | A | 8/1989 |
| JP | H02-78949 | U | 6/1990 |
| JP | H02-262168 | A | 10/1990 |
| JP | H03-212656 | A | 9/1991 |
| JP | H04-31156 | A | 2/1992 |
| JP | H04-31156 | U | 3/1992 |
| JP | H04-191773 | A | 7/1992 |
| JP | H04-112263 | U | 9/1992 |
| JP | H04-114057 | U | 10/1992 |
| JP | 5323696 | B2 | 12/1993 |
| JP | 06-208301 | A | 7/1994 |
| JP | H07-140776 | A | 6/1995 |
| JP | H07-281519 | | 10/1995 |
| JP | H08-179608 | A | 7/1996 |
| JP | H08-248838 | A | 9/1996 |
| JP | H09160466 | A | 6/1997 |
| JP | H09222783 | A | 8/1997 |
| JP | 2551714 | Y2 | 10/1997 |
| JP | H09-258634 | A | 10/1997 |
| JP | H10-301382 | A | 11/1998 |
| JP | H11-37169 | A | 2/1999 |
| JP | H11-52716 | A | 2/1999 |
| JP | 2000338760 | A | 12/2000 |
| JP | 2001-042585 | A | 2/2001 |
| JP | 2001-166648 | A | 6/2001 |
| JP | 3266779 | B2 | 3/2002 |
| JP | 2002-169449 | A | 6/2002 |
| JP | 2003-271039 | A | 9/2003 |
| JP | 2003295614 | A | 10/2003 |
| JP | 2003-337504 | A | 11/2003 |
| JP | 2004-045603 | | 2/2004 |
| JP | 2005-241942 | A | 9/2005 |
| JP | 3710375 | B2 | 10/2005 |
| JP | 2006-235236 | A | 9/2006 |
| JP | 2006-243072 | A | 9/2006 |
| JP | 2006-267994 | A | 10/2006 |
| JP | 2007-079284 | A | 3/2007 |
| JP | 2007-164095 | A | 6/2007 |
| JP | 2007-199514 | A | 8/2007 |
| JP | 2008-089731 | A | 4/2008 |
| JP | 2008-216391 | A | 9/2008 |
| JP | 2008-216392 | A | 9/2008 |
| JP | 2008-216393 | A | 9/2008 |
| JP | 2008-216394 | A | 9/2008 |
| JP | 2008216919 | A | 9/2008 |
| JP | 2008299123 | A | 12/2008 |
| JP | 2008299124 | A | 12/2008 |
| JP | 2008299125 | A | 12/2008 |
| JP | 2009069177 | A | 4/2009 |
| JP | 2009-162915 | A | 7/2009 |
| JP | 2009-180983 | A | 8/2009 |
| JP | 4310703 | B2 | 8/2009 |
| JP | 2009-223017 | A | 10/2009 |
| JP | 2009-244560 | A | 10/2009 |
| JP | 2009-276727 | A | 10/2009 |
| JP | 2009244563 | A | 10/2009 |
| JP | 4372703 | B2 | 11/2009 |
| JP | 2009-282099 | A | 12/2009 |
| JP | 2009-288549 | A | 12/2009 |
| JP | 4376861 | B2 | 12/2009 |
| JP | 2011-013323 | A | 1/2011 |
| JP | 3167011 | U | 3/2011 |
| JP | 2011-215374 | A | 10/2011 |
| JP | 4859139 | B2 | 1/2012 |
| JP | 2012-053095 | A | 3/2012 |
| JP | 2012-108537 | A | 6/2012 |
| JP | 2012-194318 | A | 10/2012 |
| JP | 2012-212086 | A | 11/2012 |
| JP | 2012-233941 | A | 11/2012 |
| JP | 2013-011911 | A | 1/2013 |
| JP | 2013501253 | A | 1/2013 |
| JP | 2013054063 | A | 3/2013 |
| RU | 2011138921 | A | 9/2013 |
| WO | 2007062588 | A1 | 6/2007 |
| WO | 2011/015051 | A1 | 2/2011 |
| WO | 2013040989 | A1 | 3/2013 |
| WO | 2013073134 | A1 | 5/2013 |

OTHER PUBLICATIONS

Aug. 20, 2015—(EP) Extended EP Search Report in App No. 15161221.5.

Feb. 27, 2014—(KR) Notice of Preliminary Rejection—App 10-2012-7028457.

Machine translation of JP 2006-235236 dated Jan. 9, 2014.

Jan. 5, 2012—(JP) Decision of Patent Grant—App 2010-083408.

Apr. 26, 2011—(WO) International Search Report (JPO)—App PCT/JP2011/057946.

Nov. 12, 2014—(US) Non-Final Office Action—U.S. Appl. No. 14/485,462.

Dec. 31, 2014—(CN) Notification of First Office Action—App 201310175410.5, Eng Tran.

Mar. 20, 2015—(US) Final Office Action—U.S. Appl. No. 14/485,462.

Decision to Grant a Patent issued in corresponding Japanese Patent Application No. 2010-193204 dated Sep. 18, 2012.

Notice of Reasons for Rejection issued in Japanese Patent Application No. 2012-229560 mailed Feb. 19, 2013.

Machine translation of JP 07-281519A dated May 2, 2013.

Machine translation of JP 10-031382A dated May 1, 2013.

Notice of Allowance received in U.S. Appl. No. 13/222,096 mailed Oct. 16, 2013.

Office Action received in related Chinese Patent Application No. 201110251898.6 mailed Oct. 15, 2013.

Notification of the First Office Action with Search Report issued in corresponding Chinese Patent Application No. 201110251898.6 dated Dec. 11, 2012.

Notice of Reasons for Rejection issued in corresponding Japanese Patent Application 2010-193204 mailed Jun. 26, 2012.

Notice of Allowance issued in corresponding U.S. Appl. No. 14/154,521 mailed Feb. 10, 2014.

Sep. 19, 2014—(US) Notice of Allowance—U.S. Appl. No. 14/275,251.

Mar. 19, 2015—(US) Non-Final Office Action—U.S. Appl. No. 14/577,396.

Co-pending U.S. Appl. No. 14/316,959, filed Jun. 27, 2014.

Co-Pending U.S. Appl. No. 14/316,971, filed Jun. 27, 2014.

Apr. 6, 2015—(US) Non-Final Office Action—U.S. Appl. No. 14/316,959.

Apr. 21, 2015—(EP) Extended Search Report—App 14173865.8.

May 8, 2015—Ex Parte Quayle—U.S. Appl. No. 14/316,971.

May 8, 2015—(US) Ex Parte Quayle—U.S. Appl. No. 14/316,971.

Mar. 3, 2015—(CN) Notification of First Office Action—App 201310175264.6, Eng Tran.

Mar. 3, 2015—(CN) Notification of First Office Action—App 201310175229.4, Eng Tran.

Apr. 14, 2014 (US) Non-Final Office Action in U.S. Appl. No. 13/628,492.

Sep. 23, 2014—(US) Notice of Allowance—U.S. Appl. No. 13/628,492.

Apr. 15, 2015—(US) Notice of Allowance—U.S. Appl. No. 14/529,221.

Aug. 4, 2015—(US) Notice of Allowance—U.S. Appl. No. 14/577,396.

Aug. 25, 2015—(US) Non-Final Office Action—U.S. Appl. No. 14/671,413.

(56) References Cited

OTHER PUBLICATIONS

Jul. 22, 2015 (US) Non-Final Office Action—U.S. Appl. No. 14/316,971.
May 18, 2015—(US) Non-Final Office Action—U.S. Appl. No. 14/611,393.
Oct. 5, 2015—(US) Non-Final Office Action—U.S. Appl. No. 14/670,801.
Sep. 17, 2015—(EP) Office Action—App 11179283.4.
Sep. 17, 2015—(US) Non-Final Office Action—U.S. Appl. No. 14/670,489.
Sep. 23, 2015—(US) Notice of Allowance—U.S. Appl. No. 14/529,221.
Sep. 30, 2015—(US) Non-Final Office Action—U.S. Appl. No. 14/670,522.
Sep. 16, 2015—(US) Notice of Allowance—U.S. Appl. No. 14/485,462.
Mar. 27, 2015—(US) Co-pending U.S. Appl. No. 14/670,676.
Feb. 8, 2016—(EP) Extended European Search Report—App 15161221.5.
Sep. 23, 2015—(EP) Extended European Search Report—App 15161223.1.
Sep. 23, 2015—(EP) Extended European Search Report—App 15161224.9.
Sep. 25, 2015—(EP) Extended European Search Report—App 15161229.8.
Sep. 29, 2015—(EP) Extended European Search Report—App 15161242.1
Sep. 17, 2015—(EP) Office Action—App 11160291.8.
Oct. 19, 2015—(US) Non-Final Office Action—U.S. Appl. No. 14/611,393.
Oct. 28, 2015—(US) Notice of Allowance—U.S. Appl. No. 14/316,959.
Dec. 14, 2015—(US) Non-Final Office Action—U.S. Appl. No. 14/926,345.
Dec. 17, 2015—(US) Non-Final Office Action—U.S. Appl. No. 14/670,676.
Jan. 20, 2016—(US) Notice of Allowance—U.S. Appl. No. 14/316,971.
Jan. 21, 2016—(US) Notice of Allowance—U.S. Appl. No. 14/485,462.
Aug. 19, 2015—(US) Non-Final Office Action—U.S. Appl. No. 14/589,696.
Sep. 16, 2013—(US) Non-final office action—U.S. Appl. No. 13/431,077.
Sep. 6, 2013—(CN) Office Action—App 201210083604.8.
Mar. 27, 2014—(US) Notice of Allowance—U.S. Appl. No. 13/431,077.
May 1, 2015—(US) Non-Final Office Action—U.S. Appl. No. 14/491,157.
Dec. 24, 2015—(US) Notice of Allowance—U.S. Appl. No. 14/491,157.
Sep. 30, 2013—(CN) Office Action—App 201210083716.3.
Nov. 19, 2013—(JP) Office Action—App 2013-103770.
Jan. 8, 2014—(US) Notice of Allowance—U.S. Appl. No. 13/430,950.
May 27, 2014—(EP) Extended Search Report—App 12161226.1.
Feb. 4, 2015—(US) Notice of Allowance—U.S. Appl. No. 14/289,780.
Jan. 20, 2015—(JP) Notification of Reasons for Refusal—App 2014-042421, Eng Tran.
Jul. 16, 2012—(EP ) Search Report—App 12157690.4.
Feb. 19, 2014—(US) Notice of Allowance—U.S. Appl. No. 13/431,074.
Jun. 19, 2014—(US) Non-final office action—U.S. Appl. No. 14/290,188.
Oct. 7, 2014—(US) Notice of Allowance—U.S. Appl. No. 14/290,188.
Feb, 25, 2016—(US) Non-Final Office Action—U.S. Appl. No. 14/316,959.
Apr. 26, 2016—(US) Non-Final Office Action—U.S. Appl. No. 15/079,829.
May 9, 2016—(US) Notice of Allowance—U.S. Appl. No. 14/670,489.
May 24, 2016—(US) Notice of Allowance—U.S. Appl. No. 14/485,462.
Jun. 29, 2016—(US) Notice of Allowance—U.S. Appl. No. 14/611,393.
Jul. 14, 2016—(US) Notice of Allowance—U.S. Appl. No. 14/670,676.
Jul. 15, 2016—(US) Notice of Allowance—U.S. Appl. No. 14/670,522.
Aug. 1, 2016—(US) Notice of Allowance—U.S. Appl. No. 14/670,516.
Aug. 9, 2016—(US) Notice of Allowance—U.S. Appl. No. 15/079,829.
Sep. 12, 2016—(US) Notice of Allowance—U.S. Appl. No. 14/589,696.
Sep. 28, 2016—(US) Notice of Allowance—U.S. Appl. No. 14/670,801.
Feb. 2, 2016—(US) Notice of Allowance—U.S. Appl. No. 14/670,516.
Feb. 17, 2016—(US) Notice of Allowance—U.S. Appl. No. 14/671,413.
Feb. 18, 2016—(US) Notice of Allowance—U.S. Appl. No. 14/529,221.
Mar. 4, 2016—(US) Notice of Allowance—U.S. Appl. No. 14/491,157.
Mar. 29, 2016—(US) Notice of Allowance—U.S. Appl. No. 14/485,462.
Apr. 1, 2016—(US) Notice of Allowance—U.S. Appl. No. 14/926,345.
Apr. 12, 2016—(US) Notice of Allowance—U.S. Appl. No. 14/611,393.
Apr. 14, 2016—(US) Notice of Allowance—U.S. Appl. No. 14/670,522.
May 27, 2016—(US) Notice of Allowance—U.S. Appl. No. 14/671,413.
Jun. 10, 2016—(US) Notice of Allowance—U.S. Appl. No. 14/316,971.
Jun. 17, 2016—(US) Notice of Allowance—U.S. Appl. No. 14/926,345.
Jun. 17, 2016—(US) Notice of Allowance—U.S. Appl. No. 14/491,157.
Jun. 22, 2016—(US) Notice of Allowance—U.S. Appl. No. 14/670,516.
May 24, 2016—(EP) Communication—App 12157679.7.
Sep. 14, 2015—(EP) Communication—App 12157679.7.
May 24, 2016—(EP) Communication—App 12157690.4.
Sep. 11, 2015—(EP) Communication—App 12157690.4.
Jul. 16, 2012—(EP) Search Report 12157679.7.
Jun. 22, 2016—(US) Notice of Allowance—U.S. Appl. No. 14/529,221.
Apr. 16, 2013 (JP) Notice of Allowance—App. 2011100507.
Feb. 17, 2015 (JP) Notice of Allowance—App. 2011078637.
May 11, 2016—(EP) Communication—App 12161226.1.
Nov. 22, 2016—(JP) Office Action—App 2013137422—Eng Tran.
Dec. 13, 2016—(JP) Office Action—App 2013137425—Eng Tran.
Dec. 12, 2016—(JP) Office Action—App 2014074727—Eng Tran.
Dec. 27, 2016—(JP) Office Action—App 2014074728—Eng Tran.
Dec. 27, 2016—(JP) Office Action—App 2014074729—Eng Tran.
Dec. 27, 2016—(JP) Office Action—App 2014074730—Eng Tran.
Dec. 13, 2016—(JP) Office Action—App 2014000609—Eng Tran.

* cited by examiner

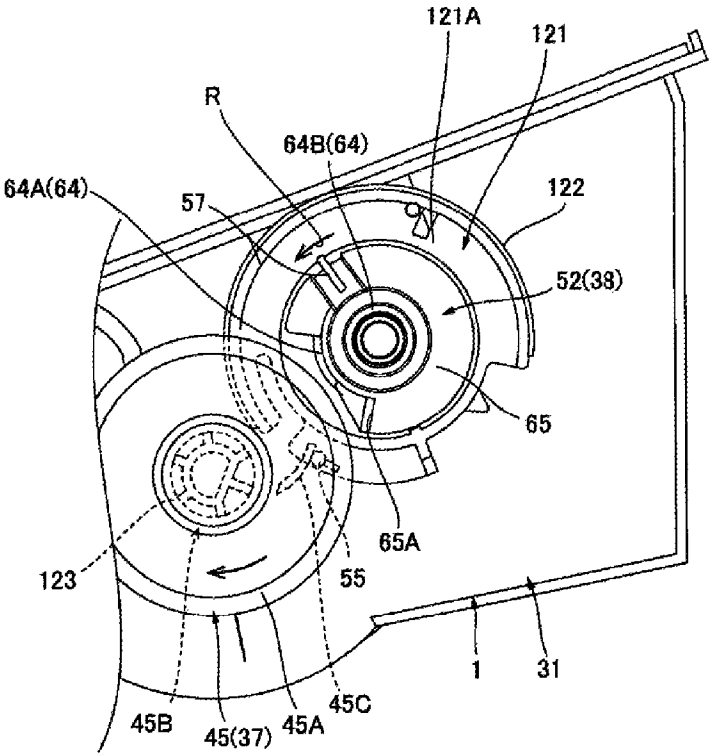
FIG.17
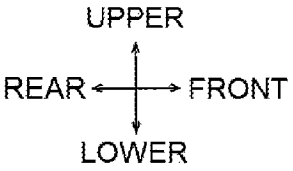

CARTRIDGE WITH MULTIPLE ROTARY MEMBERS

CROSS-REFERENCE TO RELATED APPLICATIONS

This application claims priority from Japanese Patent Application No. 2014-074728 filed on Mar. 31, 2014, the entire contents of which are incorporated herein by reference.

TECHNICAL FIELD

Aspects of the disclosure relate to a cartridge configured to be mounted to an electrophotographic image forming apparatus.

BACKGROUND

As an electrophotographic printer, a printer to which a cartridge accommodating therein developer can be detachably mounted is known.

In the known printer, when a used cartridge is replaced with an unused cartridge, it is necessary to enable the printer to recognize that the non-used cartridge has been mounted.

SUMMARY

It is therefore an object of the disclosure to provide a cartridge capable of enabling an external device to recognize that an unused cartridge has been mounted.

According to an aspect of the disclosure, there is provided a cartridge including a housing configured to accommodate therein developer, a driving receiving part configured to receive a driving force, a transmission member configured to rotate by receiving a driving force from the driving receiving part, a first rotary member configured to rotate by abutting on the transmission member and receiving a driving force from the transmission member, a second rotary member configured to abut on the transmission member by receiving a driving force from the first rotary member, and rotate by abutting on the transmission member and receiving a driving force from the transmission member, and a detected part configured to move in accordance with the rotation of the second rotary member.

BRIEF DESCRIPTION OF DRAWINGS

FIG. 17 illustrates a seventh modified embodiment of the developing cartridge.

DETAILED DESCRIPTION

1. Outline of Developing Cartridge

Figure 1:
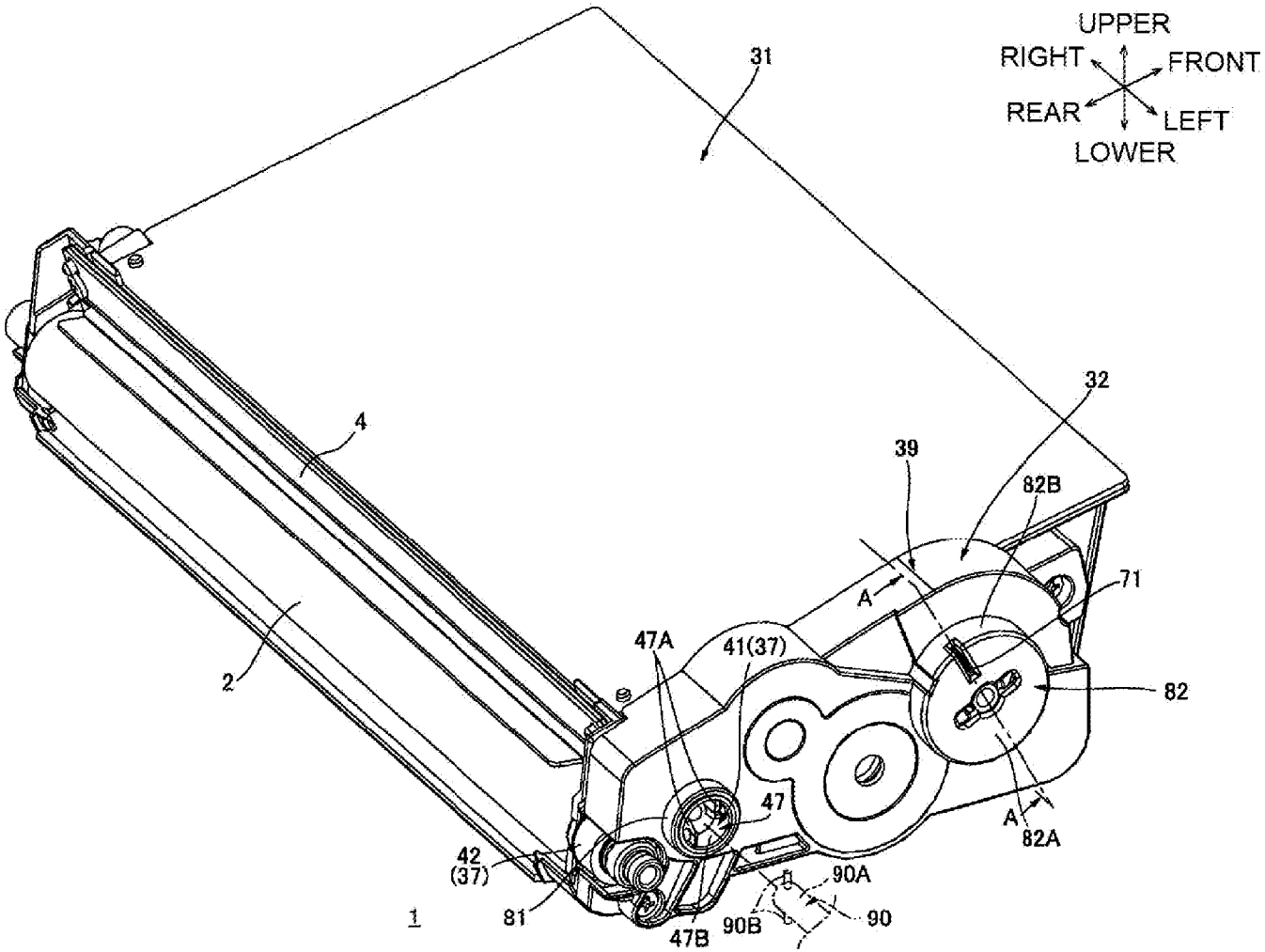
FIG. 1 is a perspective view of a developing cartridge according to an illustrative embodiment of the cartridge of the disclosure, as seen from a left-rear side.
Figure 2:
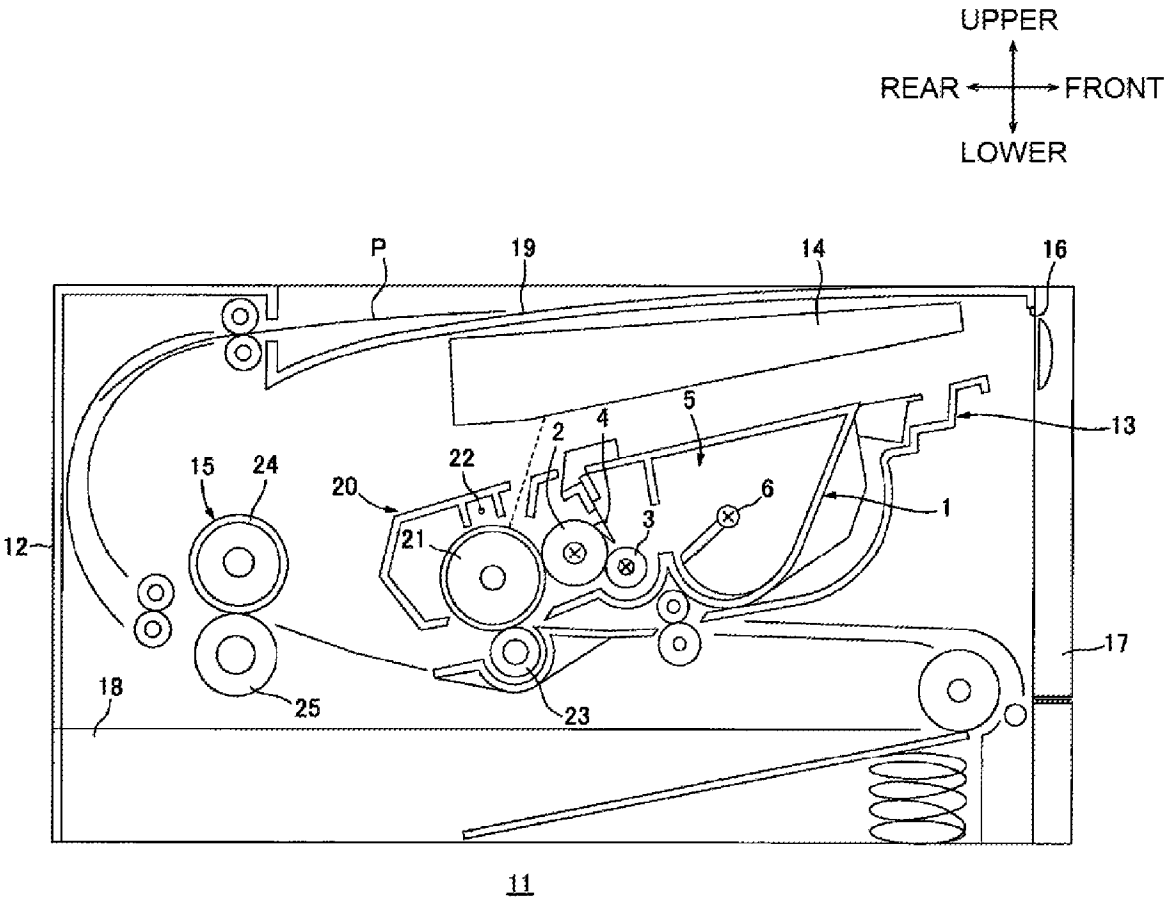
FIG. 2 is a central sectional view of a printer to which the developing cartridge of FIG. 1 is mounted.

As shown in FIGS. 1 and 2, a developing cartridge 1, which is an example of the cartridge, has a developing roller 2, which is an example of the developer carrier, a supply roller 3, a layer thickness regulation blade 4 and a toner accommodation part 5.

In the description hereinafter, directions of the developing cartridge 1 are described on the basis of a state where the developing cartridge 1 is horizontally placed. Specifically, arrow directions indicated in FIG. 1 are used as the basis. A left-right direction is an example of the axis direction.

The developing roller 2 is rotatably supported by a rear end portion of the developing cartridge 1. The developing roller 2 has a substantially cylindrical shape extending in the left-right direction.

The supply roller 3 is arranged at a front-lower side of the developing roller 2. The supply roller 3 is rotatably supported by the developing cartridge 1. The supply roller 3 has a substantially cylindrical shape extending in the left-right direction. The supply roller 3 contacts a front lower end portion of the developing roller 2.

The layer thickness regulation blade 4 is arranged at a front-upper side of the developing roller 2. The layer thickness regulation blade 4 contacts a front end portion of the developing roller 2.

The toner accommodation part 5 is arranged in front of the supply roller 3 and the layer thickness regulation blade 4. The toner accommodation part 5 is configured to accommodate therein toner, which is an example of the developer. The toner accommodation part 5 has an agitator 6.

The agitator 6 is rotatably supported in the toner accommodation part 5.

2. Using Aspects of Developing Cartridge

As shown in FIG. 2, the developing cartridge 1 is used while being mounted to an image forming apparatus 11.

The image forming apparatus 11 is an electrophotographic monochrome printer. The image forming apparatus 11 has an apparatus main body 12, which is an example of the external device, a process cartridge 13, a scanner unit 14, and a fixing unit 15.

The apparatus main body 12 has a substantially box shape. The apparatus main body 12 has an opening 16, a front cover 17, a sheet feeding tray 18, and a sheet discharge tray 19.

The opening 16 is arranged at a front end portion of the apparatus main body 12. The opening 16 enables an inside and an outside of the apparatus main body 12 to communicate with each other so that the process cartridge 13 can pass therethrough.

The front cover 17 is arranged at the front end portion of the apparatus main body 12. The front cover 17 has a substantially flat plate shape. The front cover 17 extends in the upper-lower direction, and is swingably supported by a front wall of the apparatus main body 12 at a lower end portion thereof serving as a support point. The front cover 17 is configured to open or close the opening 16.

The sheet feeding tray 18 is arranged at a bottom of the apparatus main body 12. The sheet feeding tray 18 is configured to accommodate therein sheets P.

The sheet discharge tray 19 is arranged at a center of an upper wall of the apparatus main body 12. The sheet discharge tray 19 is recessed downwardly from an upper surface of the apparatus main body 12 so that the sheet P can be placed thereon.

The process cartridge 13 is accommodated at a substantially center of the apparatus main body 12 in the upper-lower direction. The process cartridge 13 is configured to be mounted to or to be detached from the apparatus main body 12. The process cartridge 13 has a drum cartridge 20, and the developing cartridge 1.

The drum cartridge 20 has a photosensitive drum 21, a scorotron-type charger 22, and a transfer roller 23.

The photosensitive drum 21 is rotatably supported by a rear end portion of the drum cartridge 20.

The scorotron-type charger 22 is arranged at an interval from the photosensitive drum 21 at a rear-upper side of the photosensitive drum 21.

The transfer roller 23 is arranged below the photosensitive drum 21. The transfer roller 23 contacts a lower end portion of the photosensitive drum 21.

The developing cartridge 1 is detachably mounted to the drum cartridge 20 so that the developing roller 2 contacts a front end portion of the photosensitive drum 21, in front of the photosensitive drum 21.

The scanner unit 14 is arranged above the process cartridge 13. The scanner unit 14 is configured to emit a laser beam based on image data towards the photosensitive drum 21.

The fixing unit 15 is arranged at the rear of the process cartridge 13. The fixing unit 15 has a heating roller 24, and a pressing roller 25 pressed to a rear lower end portion of the heating roller 24.

When the image forming apparatus 11 starts an image forming operation, the scorotron-type charger 22 uniformly charges a surface of the photosensitive drum 21. The scanner unit 14 exposes the surface of the photosensitive drum 21. Thereby, an electrostatic latent image based on the image data is formed on the surface of the photosensitive drum 21.

Also, the agitator 6 is stirs the toner in the toner accommodation part 5, thereby supplying the same to the supply roller 3. The supply roller 3 supplies the toner supplied by the agitator 6 to the developing roller 2. At this time, the toner is positively friction-charged between the developing roller 2 and the supply roller 3, and is then carried on the developing roller 2. The layer thickness regulation blade 4 is regulates a layer thickness of the toner carried on the developing roller 2 to a predetermined thickness.

The toner carried on the developing roller 2 is supplied to the electrostatic latent image on the surface of the photosensitive drum 21. Thereby, a toner image is carried on the surface of the photosensitive drum 21.

The sheet P is fed one by one at predetermined timing from the sheet feeding tray 18 towards between the photosensitive drum 21 and the transfer roller 23 by rotations of a variety of rollers. The toner image on the surface of the photosensitive drum 21 is transferred to the sheet P when the sheet P passes between the photosensitive drum 21 and the transfer roller 23.

Thereafter, the sheet P is heated and pressed while it passes between the heating roller 24 and the pressing roller 25. Thereby, the toner image on the sheet P is heat-fixed to the sheet P. Then, the sheet P is discharged to the sheet discharge tray 19.

3. Details of Developing Cartridge

As shown in FIG. 1, the developing cartridge 1 has a developing frame 31, which is an example of the housing, and a driving unit 32.

(1) Developing Frame

Figure 3A:
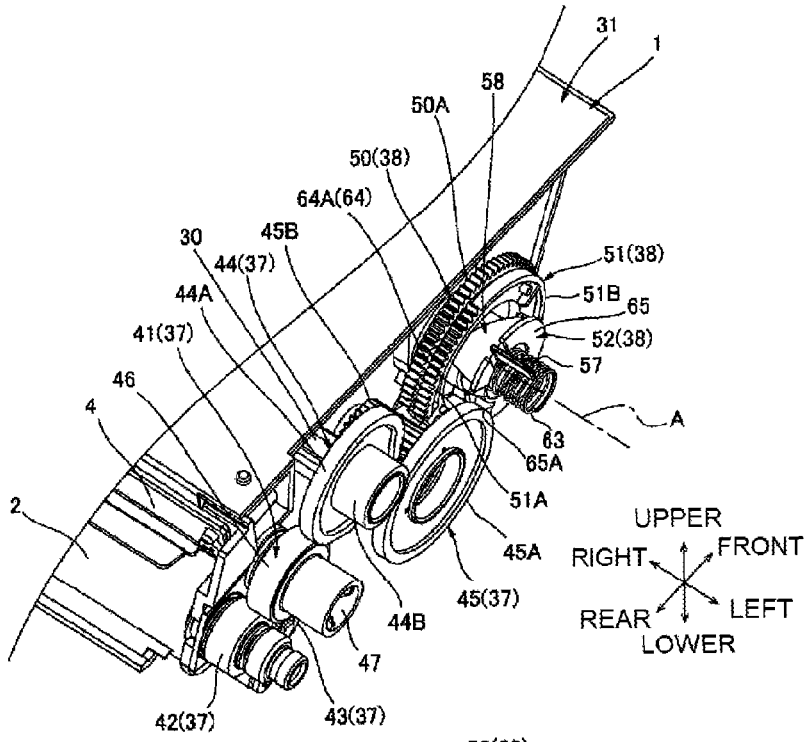
FIG. 3A is a perspective view of the developing cartridge shown in FIG. 1 with a gear cover being detached, as seen from a left-rear side.
Figure 4:
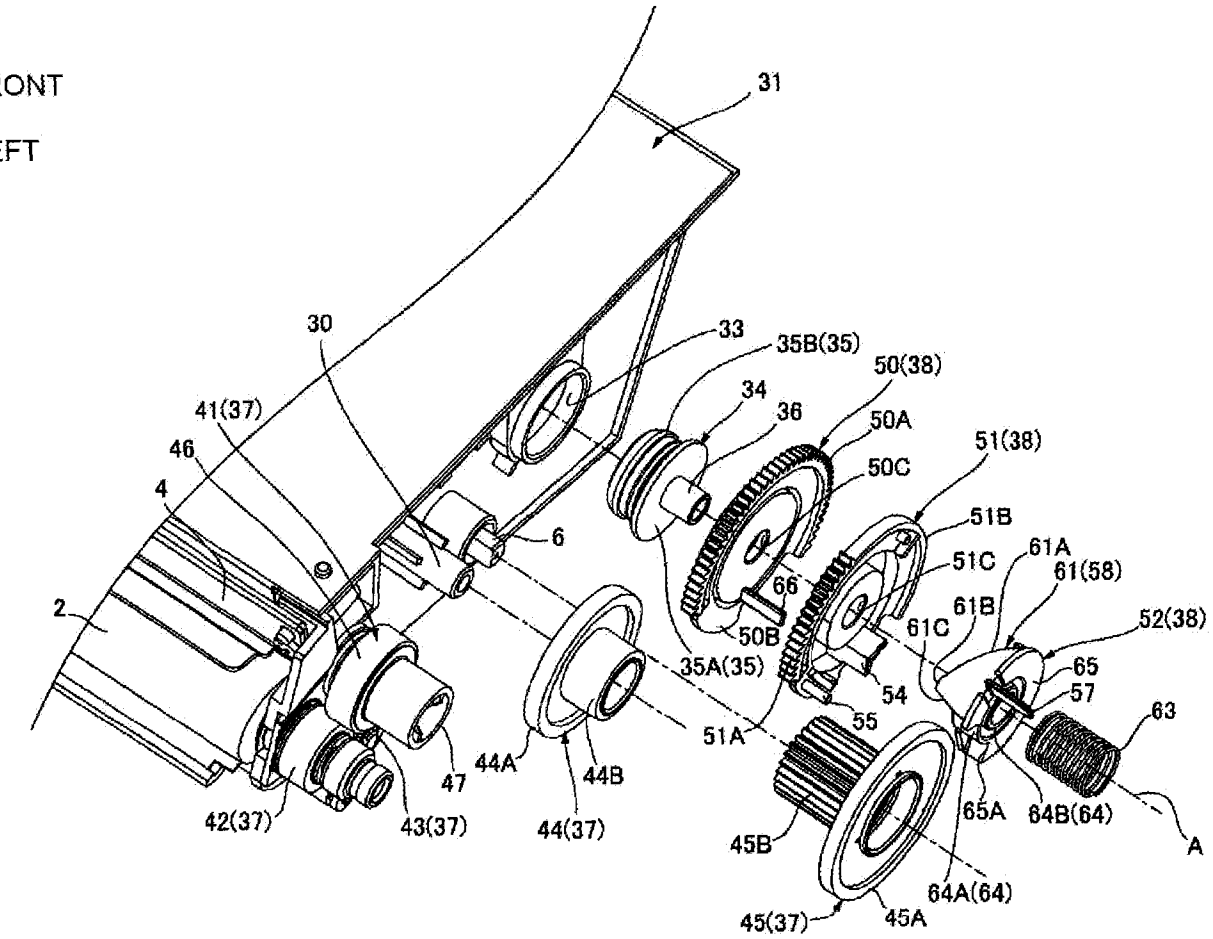
FIG. 4 is an exploded perspective view of the developing cartridge shown in FIG. 3A, as seen from a left-rear side.
Figure 4:
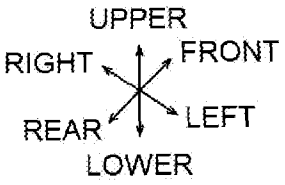

The developing frame 31 has a substantially box shape, as shown in FIGS. 3A and 4. The developing frame 31 has the toner accommodation part 5 and supports the developing roller 2, the supply roller 3, the layer thickness regulation blade 4 and the agitator 6. The developing frame 31 has an idle gear support shaft 30, a toner filling port 33, which is an example of the filling port, and a toner cap 34, which is an example of the closing member.

The idle gear support shaft 30 is arranged at a substantially center of an upper end portion of a left wall of the developing frame 31 in the front-rear direction. The idle gear support shaft 30 has a substantially cylindrical shape extending leftward from the left wall of the developing frame 31. The idle gear support shaft 30 is formed integrally with the left wall of the developing frame 31.

The toner filling port 33 is arranged at a front end portion of the left wall of the developing frame 31. The toner filling port 33 has a substantially circular shape, in a side view, and penetrates the left wall of the developing frame 31 in the left-right direction.

The toner cap 34 is fitted in the toner filling port 33 to close the toner filling port 33. The toner cap 34 has a cap main body 35, and a support shaft 36, which is an example of the second support part.

The cap main body 35 has a substantially cylindrical shape extending in the left-right direction and having a closed left end portion. The cap main body 35 has a closing part 35A and an insertion part 35B.

The closing part 35A is arranged at the left end portion of the cap main body 35. The closing part 35A has a substantially disc shape having a thickness in the left-right direction. An outer diameter of the closing part 35A is greater than an inner diameter of the toner filling port 33.

The insertion part 35B has a substantially cylindrical shape extending rightward from a right surface of the closing part 35A. An outer diameter of the insertion part 35B is smaller than the outer diameter of the closing part 35A and slightly greater than the inner diameter of the toner filling port 33. The insertion part 35B is inserted into the toner filling port 33.

The support shaft 36 has a substantially cylindrical shape extending leftward from a substantially center of the left surface of the closing part 35A. A left end portion of the support shaft 36 opens.

(2) Driving Unit

As shown in FIGS. 1 and 3A, the driving unit 32 is arranged at the left of the developing frame 31 at the left end portion of the developing cartridge 1. The driving unit 32 has a gear train 37, a detection unit 38, a gear cover 39, which is an example of the covering member, and a compression spring 63, which is an example of the urging member.

(2-1) Gear Train

Figure 3B:
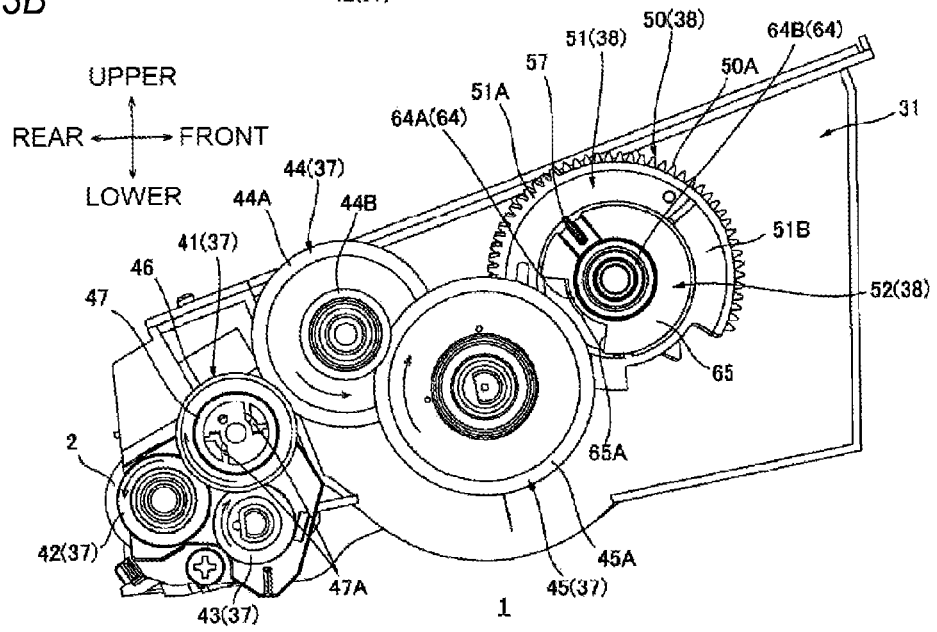
FIG. 3B is a left side view of the developing cartridge shown in FIG. 3A.

As shown in FIGS. 3A and 3B, the gear train 37 has a developing coupling 41, which is an example of the driving receiving part, a developing gear 42, a supply gear 43, an idle gear 44, and an agitator gear 45, which is an example of the transmission member.

The developing coupling 41 is arranged at a rear end portion of the developing cartridge 1. The developing coupling 41 has a substantially cylindrical shape extending in the left-right direction. The developing coupling 41 is rotatably supported by a support shaft (not shown) provided integrally for the left wall of the developing frame 31. The developing coupling 41 has a gear part 46 and a coupling part 47.

The gear part 46 is arranged at a substantially right half part of the developing coupling 41. The gear part 46 has a substantially cylindrical shape extending in the left-right direction and having a closed left end portion. The gear part 46 has gear teeth over an entire circumference thereof.

The coupling part 47 has a substantially cylindrical shape extending leftward from a left wall of the gear part 46 and having an opened left end portion. The coupling part 47 shares a central axis with the gear part 46. The coupling part 47 has a pair of protrusions 47A.

The pair of protrusions 47A are respectively arranged at an interval from each other in a diametrical direction of the coupling part 47 in an inner space 47B of the coupling part 47 in the diametrical direction. Each of the pair of protrusions 47A protrudes inward, in the diametrical direction, from an inner peripheral surface of the coupling part 47, and has a substantially rectangular shape, in a side view.

The developing gear 42 is arranged at a rear-lower side of the developing coupling 41. The developing gear 42 has a substantially disc shape having a thickness in the left-right direction. The developing gear 42 has gear teeth over an entire circumference thereof. The developing gear 42 is supported by a left end portion of a rotary shaft of the developing roller 2 so that it cannot be relatively rotated. The developing gear 42 is engaged with a rear lower end portion of the gear part 46 of the developing coupling 41.

The supply gear 43 is arranged below the developing coupling 41. The supply gear 43 has a substantially disc shape having a thickness in the left-right direction. The supply gear 43 has gear teeth over an entire circumference thereof. The supply gear 43 is supported by a left end portion of a rotary shaft of the supply roller 3 so that it cannot be relatively rotated. The supply gear 43 is engaged with a lower end portion of the gear part 46 of the developing coupling 41.

The idle gear 44 is arranged at a front-upper side of the developing coupling 41. The idle gear 44 is rotatably supported by the idle gear support shaft 30. The idle gear 44 integrally has a large diameter gear 44A and a small diameter gear 44B.

The large diameter gear 44A is arranged at a right end portion of the idle gear 44. The large diameter gear 44A has a substantially disc shape having a thickness in the left-right direction. The large diameter gear 44A has gear teeth over an entire circumference thereof. The large diameter gear 44A is engaged with a front upper end portion of the gear part 46 of the developing coupling 41.

The small diameter gear 44B has a substantially cylindrical shape extending leftward from a left surface of the large diameter gear 44A. The small diameter gear 44B shares a central axis with the large diameter gear 44A. An outer diameter of the small diameter gear 44B is smaller than an outer diameter of the large diameter gear 44A. The small diameter gear 44B has gear teeth over an entire circumference thereof.

Figure 8A:
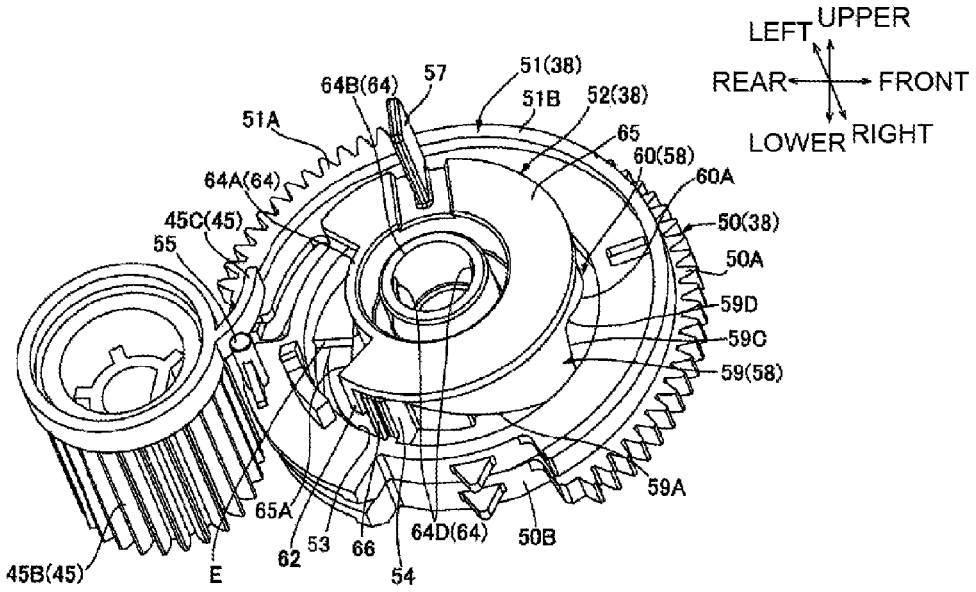
FIG. 8A illustrates a new product detection operation of the developing cartridge, which illustrates a state just before an abutting rib of an agitator gear abuts on a boss of a first toothless gear.

The agitator gear 45 is arranged at a front-lower side of the idle gear 44. The agitator gear 45 is supported by a left end portion of a rotary shaft of the agitator 6 so that it cannot be relatively rotated. The agitator gear 45 has a first gear part 45A, a second gear part 45B, which is an example of the transmitting part, and an abutting rib 45C, which is an example of the engaging part, as shown in FIGS. 4 and 8A.

The first gear part 45A is arranged at a left end portion of the agitator gear 45. The first gear part 45A has a substantially disc shape having a thickness in the left-right direction. The first gear part 45A has gear teeth over an entire circumference thereof. The first gear part 45A is engaged with a front lower end portion of the small diameter gear 44B of the idle gear 44.

The second gear part 45B has a substantially cylindrical shape extending rightward from a right surface of the first gear part 45A. The second gear part 45B shares a central axis with the first gear part 45A. An outer diameter of the second gear part 45B is smaller than an outer diameter of the first gear part 45A. The second gear part 45B has gear teeth over an entire circumference thereof. The second gear part 45B has an interval from the large diameter gear 44A of the idle gear 44.

The abutting rib 45C protrudes rightwards from the right surface of the first gear part 45A. In the meantime, the first gear part 45A is omitted in FIG. 8A. The abutting rib 45C extends so that it is inclined in a counterclockwise direction towards the outer side of the agitator gear 45 in the diametrical direction, as seen from the left side, and has a substantially flat plate shape.

(2-2) Detection Unit

The detection unit 38 has a first toothless gear 51, which is an example of the first rotary member, a second toothless gear 50, which is an example of the second rotary member, and a detection member 52, which is an example of the detected member.

The first toothless gear 51 has a substantially disc shape having a thickness in the left-right direction. The first toothless gear 51 has a teeth part 51A, which is an example of the first transmitted part, a toothless part 51B, which is an example of the first non-contact part, and an insertion hole 51C.

The teeth part 51A is a part occupying about one-sixth (⅙) of the first toothless gear 51 in a circumferential direction, and corresponds to a fan-shaped part having a central angle of about 60° of the first toothless gear 51, in a side view. The teeth part 51A has gear teeth over an entire circumference thereof. An angle θ1 between a line L1 connecting a tooth tip of a most downstream gear tooth of the teeth part 51A in the counterclockwise direction, as seen from the left side, and a center of the first toothless gear 51 and a line L2 connecting a most upstream end portion in the counterclockwise direction, as seen from the left side, of an upstream gear tooth of the teeth part 51A in the counterclockwise direction, as seen from the left side, and the center of the first toothless gear 51 is specifically 78.5°.

The toothless part 51B is a part occupying about five-sixths (⅚) of the first toothless gear 51 in the circumferential direction, except for the teeth part 51A, and corresponds to a fan-shaped part having a central angle of about 300° of the first toothless gear 51, in a side view. The toothless part 51B does not have gear teeth and does not abut on the second gear part 45B of the agitator gear 45. The toothless part 51B has a boss 55, which is an example of the engaged part, a first slide part 54, which is an example of the first operating part, and an opening 53, which is an example of the through-hole.

The boss 55 is arranged at an upstream end portion of the toothless part 51B in the counterclockwise direction, as seen from the left side. The boss 55 has a substantially cylindrical shape protruding leftward from a left surface of the toothless part 51B.

The first slide part 54 is arranged at an inner side of the boss 55 in the diametrical direction and at a downstream side in the counterclockwise direction, as seen from the left side. The first slide part 54 has a substantially flat plate shape protruding leftward from the left surface of the toothless part 51B and extending in the diametrical direction of the first toothless gear 51.

The opening 53 is arranged to be close to an upstream side of the first slide part 54 in the counterclockwise direction, as seen from the left side. The opening 53 has a substantially rectangular shape extending in a circumferential direction of the toothless part 51B, in a side view.

The insertion hole 51C is arranged at a central portion of the first toothless gear 51 in the diametrical direction. The insertion hole 51C penetrates the first toothless gear 51 in the left-right direction, and has a substantially circular shape, in a side view. An inner diameter of the insertion hole 51C is substantially the same as an outer diameter of the support shaft 36 (see FIG. 4) of the toner cap 34.

The second toothless gear 50 has a substantially disc shape having a thickness in the left-right direction. The second toothless gear 50 has a teeth part 50A, which is an example of the second transmitted part, a toothless part 50B, which is an example of the second non-contact part, and an insertion hole 50C.

The teeth part 50A is a part occupying about two-thirds (⅔) of the second toothless gear 50 in a circumferential direction, and corresponds to a fan-shaped part having a central angle of about 240° of the second toothless gear 50, in a side view. The teeth part 50A has gear teeth over an entire circumference thereof. An angle θ2 between a line L3 connecting a tooth tip of a most downstream gear tooth of the teeth part 50A in the counterclockwise direction, as seen from the left side, and a center of the second toothless gear 50 and a line L4 connecting a most upstream end portion in the counterclockwise direction, as seen from the left side, of a most upstream gear tooth of the teeth part 50A in the counterclockwise direction, as seen from the left side, and the center of the second toothless gear 50 is specifically 231.1°.

The toothless part 50B is a part occupying about one-third (⅓) of the second toothless gear 50 in the circumferential direction, except for the teeth part 50A, and corresponds to a fan-shaped part having a central angle of about 120° of the second toothless gear 50, in a side view. The toothless part 50B does not have gear teeth and does not abut on the second gear part 45B of the agitator gear 45. The toothless part 50B has a second slide part 66, which is an example of the second part and the second operating part.

The second slide part 66 is arranged at a circumferential center of the toothless part 50B. The second slide part 66 has a substantially flat plate shape protruding leftward from the left surface of the toothless part 50B and extending in the diametrical direction of the second toothless gear 50.

The insertion hole 50C is arranged at a central portion of the second toothless gear 50 in the diametrical direction. The insertion hole 50C penetrates the second toothless gear 50 in the left-right direction, and has a substantially circular shape, in a side view. An inner diameter of the insertion hole 50C is the same as the inner diameter of the first toothless gear 51.

Figure 5:
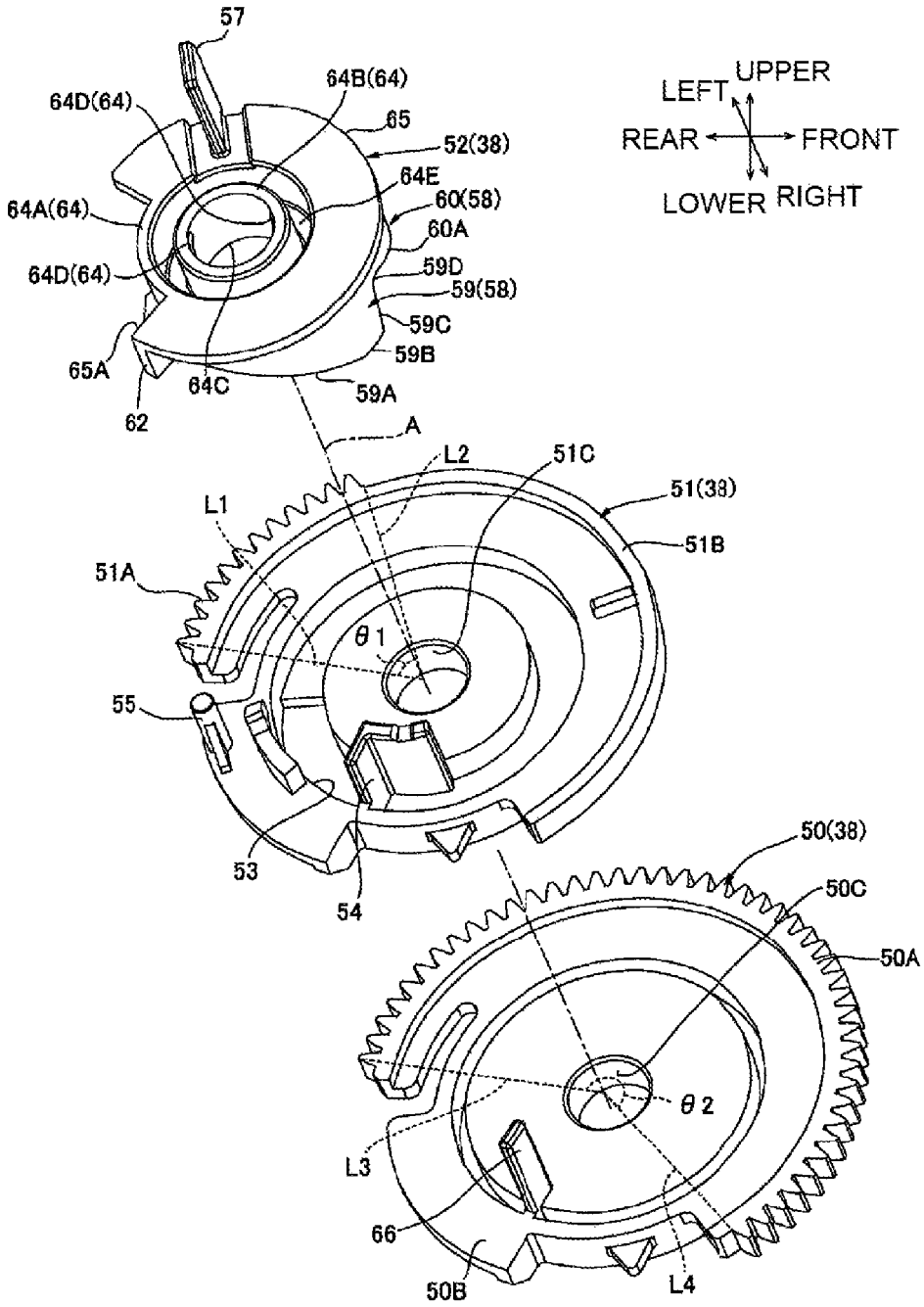
FIG. 5 is an exploded perspective view of a detection unit shown in FIG. 4, as seen from a left-lower side.
Figure 6A:
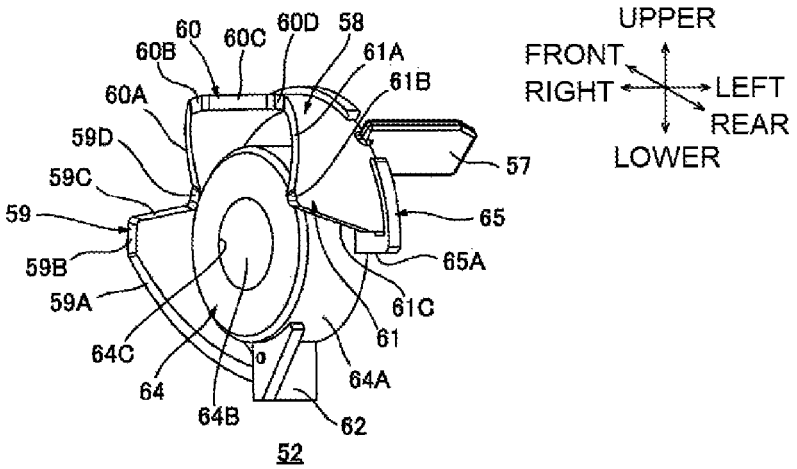
FIG. 6A is a perspective view of a detection member shown in FIG. 5, as seen from a rear-lower side.

As shown in FIGS. 5 and 6A, the detection member 52 has a substantially cylindrical shape extending in the left-right direction. The detection member 52 has a cylindrical part 64, a collar part 65, a detection projection 57, which is an example of the detected part, a displacement part 58, which is an example of the abutment part, and a stopper 62.

The cylindrical part 64 is arranged at a substantially diametrical center of the detection member 52. The cylindrical part 64 has an outer cylinder 64A and an inner cylinder 64B.

The outer cylinder 64A has a substantially cylindrical shape extending in the left-right direction and having a closed right end portion. The outer cylinder 64A has an insertion hole 64C.

The insertion hole 64C is arranged at a central portion of a right wall 64E of the outer cylinder 64A in the diametrical direction. The insertion hole 64C penetrates the right wall 64E of the outer cylinder 64A in the left-right direction and has a substantially circular shape, in a side view. A center of the insertion hole 64C coincides with a central axis of the outer cylinder 64A, when projected in the left-right direction.

Figure 6B:
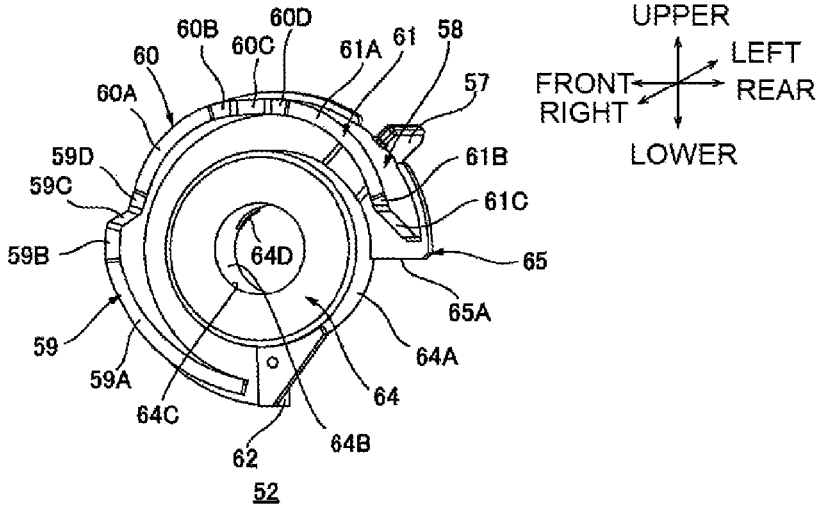
FIG. 6B is a perspective view of the detection member shown in FIG. 6A, as seen from a right-rear side.

The inner cylinder 64B is arranged at an inner side of the outer cylinder 64A in the diametrical direction. The inner cylinder 64B extends leftward continuously from a peripheral edge part of the insertion hole 64C at the diametrical center of the right wall 64E of the outer cylinder 64A, and has a substantially cylindrical shape. A central axis of the inner cylinder 64B coincides with the central axis of the outer cylinder 64A. An inner diameter of the inner cylinder 64B is the same as an inner diameter of the insertion hole 64C. As shown in FIG. 6B, the inner cylinder 64B has a pair of engaging projections 64D.

The pair of engaging projections 64D is respectively arranged on both inner surfaces of the inner cylinder 64B in the diametrical direction. Each of the pair of engaging projections 64D is a protrusion protruding inward, in the diametrical direction, from the inner surface of the inner cylinder 64B and extending circumferentially.

The collar part 65 protrudes outward, in the diametrical direction, from an outer surface of a left end portion of the outer cylinder 64A in the diametrical direction and extends in the circumferential direction of the outer cylinder 64A. The collar part 65 has a substantially C-shaped plate shape of which a rear end portion is notched over about a quarter (¼) thereof in the circumferential direction, in a side view. In other words, a notched portion 65A of the collar part 65 is notched forward from a rear end edge of the collar part 65. The notched portion 65A of the collar part 65 is an example of the notched portion of the detection member 52.

The detection projection 57 is arranged at an upper end portion of the collar part 65. The detection projection 57 has a substantially flat plate shape protruding leftward from the left surface of the collar part 65 and extending in the diametrical direction of the detection member 52.

The displacement part 58 is arranged at the peripheral edge part of the collar part 65. The displacement part 58 has a substantially C-shaped flat plate shape protruding rightward from the right surface of the peripheral edge part of the collar part 65 and extending in the circumferential direction of the collar part 65. The displacement part 58 has a first displacement part 59, a second displacement part 60, and a third displacement part 61.

The first displacement part 59 is arranged at an upstream end portion of the displacement part 58 in the counterclockwise direction, as seen from the left side. The first displacement part 59 has a first inclined surface 59A, which is an example of the inclined part, a first parallel surface 59B, a second inclined surface 59C, and a second parallel surface 59D.

The first inclined surface 59A is arranged at an upstream end portion of the first displacement part 59 in the counterclockwise direction, as seen from the left side. The first inclined surface 59A continues to the right surface of the collar part 65 and is inclined rightward towards the downstream side in the counterclockwise direction, as seen from the left side.

The first parallel surface 59B continues to a downstream side of the first inclined surface 59A in the counterclockwise direction, as seen from the left side, and extends in the counterclockwise direction, as seen from the left side. The first parallel surface 59B is parallel with the right surface of the collar part 65 so that a distance thereof from the right surface of the collar part 65 in the left-right direction is constant.

The second inclined surface 59C continues to a downstream side of the first parallel surface 59B in the counterclockwise direction, as seen from the left side, and is inclined leftward towards the downstream side in the counterclockwise direction, as seen from the left side.

The second parallel surface 59D continues to a downstream side of the second inclined surface 59C in the counterclockwise direction, as seen from the left side, and extends in the counterclockwise direction, as seen from the left side. The second parallel surface 59D is parallel with the right surface of the collar part 65 so that a distance thereof from the right surface of the collar part 65 in the left-right direction is constant.

The second displacement part 60 is arranged to continue to a downstream side of the first displacement part 59 in the counterclockwise direction, as seen from the left side. The second displacement part 60 has a first inclined surface 60A, which is an example of the inclined part, a first parallel surface 60B, a second inclined surface 60C, and a second parallel surface 60D.

The first inclined surface 60A is arranged at an upstream end portion of the second displacement part 60 in the counterclockwise direction, as seen from the left side. The first inclined surface 60A continues to the second parallel surface 59D of the first displacement part 59 and is inclined rightward towards the downstream side in the counterclockwise direction, as seen from the left side.

The first parallel surface 60B continues to a downstream side of the first inclined surface 60A in the counterclockwise direction, as seen from the left side, and extends in the counterclockwise direction, as seen from the left side. The first parallel surface 60B is parallel with the right surface of the collar part 65 so that a distance thereof from the right surface of the collar part 65 in the left-right direction is constant.

The second inclined surface 60C continues to a downstream side of the first parallel surface 60B in the counterclockwise direction, as seen from the left side, and is inclined leftward towards the downstream side in the counterclockwise direction, as seen from the left side.

The second parallel surface 60D continues to a downstream side of the second inclined surface 60C in the counterclockwise direction, as seen from the left side, and extends in the counterclockwise direction, as seen from the left side. The second parallel surface 60D is parallel with the right surface of the collar part 65 so that a distance thereof from the right surface of the collar part 65 in the left-right direction is constant.

The third displacement part 61 is arranged to continue to a downstream side of the second displacement part 60 in the counterclockwise direction, as seen from the left side. The third displacement part 61 has a first inclined surface 61A, which is an example of the inclined part, a parallel surface 61B, and a second inclined surface 61C.

The first inclined surface 61A is arranged at an upstream end portion of the third displacement part 61 in the counterclockwise direction, as seen from the left side. The first inclined surface 61A continues to the second parallel surface 60D of the second displacement part 60 and is inclined rightward towards the downstream side in the counterclockwise direction, as seen from the left side.

The parallel surface 61B continues to a downstream side of the first inclined surface 61A in the counterclockwise direction, as seen from the left side, and extends in the counterclockwise direction, as seen from the left side. The parallel surface 61B is parallel with the right surface of the collar part 65 so that a distance thereof from the right surface of the collar part 65 in the left-right direction is constant.

The second inclined surface 61C continues to a downstream side of the parallel surface 61B in the counterclockwise direction, as seen from the left side, and is inclined leftward towards the downstream side in the counterclockwise direction, as seen from the left side.

The stopper 62 has a substantially flat plate shape protruding rightward from the upstream end portion of the collar part 65 in the counterclockwise direction, as seen from the left side, and extending in the diametrical direction of the collar part 65.

(2-3) Gear Cover

Figure 7:
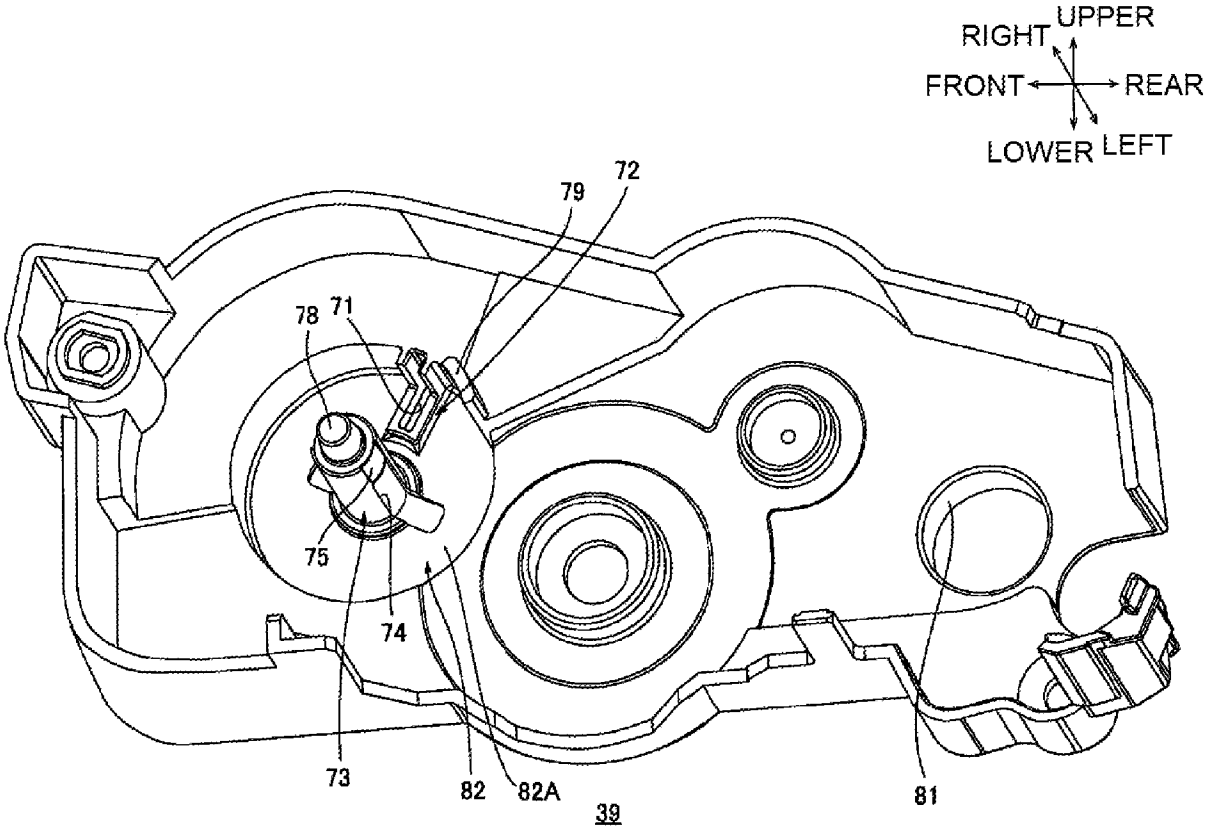
FIG. 7 is a perspective view of the gear cover shown in FIG. 1, as seen from a right-lower side.

As shown in FIGS. 1 and 7, the gear cover 39 is supported by the left end portion of the developing frame 31. The gear cover 39 has a substantially square tube shape extending in the left-right direction and having a closed left end portion. The gear cover 39 covers the gear train 37 and the detection unit 38. The gear cover 39 has a coupling collar 81 and a detection member accommodation part 82.

The coupling collar 81 is arranged at a rear end portion of the gear cover 39. The coupling collar 81 has a substantially cylindrical shape penetrating a left wall of the gear cover 39 and extending in the left-right direction. An inner diameter of the coupling collar 81 is substantially the same as an outer diameter of the coupling part 47 of the developing coupling 41. The coupling part 47 of the developing coupling 41 is rotatably fitted in the coupling collar 81.

The detection member accommodation part 82 is arranged at a front end portion of the gear cover 39. The detection member accommodation part 82 has a substantially cylindrical shape extending leftward from a left surface of the gear cover 39 and having a closed left end portion. A left wall 82A of the detection member accommodation part 82 is an example of the covering part. In the meantime, a right end portion of the detection member accommodation part 82 communicates with an inside of the gear cover 39. The detection member accommodation part 82 accommodates therein the detection member 52. The detection member accommodation part 82 has a slit 71 and a support shaft 73, which is an example of the first support part.

The slit 71 is arranged at an upper end portion of the detection member accommodation part 82. The slit 71 penetrates the left wall 82A of the detection member accommodation part 82 in the left-right direction and extends in a diametrical direction of the detection member accommodation part 82.

The support shaft 73 has a substantially cylindrical shape extending rightward from a diametrical center of the left wall 82A of the detection member accommodation part 82. An outer diameter of the support shaft 73 is the same as the inner diameter of the insertion hole 64C of the detection member 52. The support shaft 73 has guide recesses 74, engaging claws 75 and a protrusion 78.

The guide recesses 74 are arranged at both end portions of the support shaft 73 in the front-rear direction. The guide recess 74 is recessed inward, in the diametrical direction, from an outer peripheral surface of the support shaft 73 and extends in the left-right direction.

The engaging claw 75 is arranged in a right end portion of the guide recess 74. The engaging claw 75 protrudes outward, in the diametrical direction, from an inner surface of the guide recess 74 in the diametrical direction. An outer surface of the engaging claw 75 in the diametrical direction is inclined towards the outer side in the diametrical direction towards the left side.

The protrusion 78 is arranged at a right end portion of the support shaft 73. The protrusion 78 has a substantially cylindrical shape protruding rightward from a right surface of the support shaft 73 and having a diameter that is gradually decreased towards the right side. The protrusion 78 is fitted in a left end portion of the support shaft 36 (see FIG. 4) of the toner cap 34. Thereby, the support shaft 73 of the gear cover 39 configures a support part, together with the support shaft 36 of the toner cap 34.

As shown in FIG. 3A, the compression spring 63 is a coil spring extending in the left-right direction. A left end portion of the compression spring 63 abuts on the left wall 82A of the detection member accommodation part 82 of the gear cover 39. A right end portion of the compression spring 63 abuts on the right wall 64E of the outer cylinder 64A of the detection member 52. Thereby, the compression spring 63 always urges the detection member 52 rightward towards the first toothless gear 51.

(2-4) Mounted State of Detection Unit

Hereinafter, a mounted state of the detection unit 38 is described.

As shown in FIGS. 3A and 4, the second toothless gear 50 is rotatably supported by the support shaft 36 of the toner cap 34. The first toothless gear 51 is rotatably supported by the support shaft 36 of the toner cap 34 so that it overlaps with the second toothless gear 50 at the left of the second toothless gear 50. The support shaft 36 of the toner cap 34 is fitted in the insertion hole 51C of the first toothless gear 51 and in the insertion hole 50C of the second toothless gear 50 so that it can be relatively rotated.

The second slide part 66 of the second toothless gear 50 is fitted in a downstream end portion of the opening 53 of the first toothless gear 51 in the counterclockwise direction, as seen from the left side. The second slide part 66 of the second toothless gear 50 protrudes leftward from the opening 53 of the first toothless gear 51 and is arranged to overlap with an upstream side of the first slide part 54 of the first toothless gear 51 in the counterclockwise direction, as seen from the left side.

As shown in FIGS. 4 and 7, the detection member 52 is supported by the support shaft 73 of the gear cover 39 so that it cannot rotate and can move in the left-right direction.

The support shaft 73 of the gear cover 39 is fitted in the insertion hole 64C and the inner cylinder 64B of the detection member 52. The engaging projections 64D of the detection member 52 are fitted in the guide recesses 74 at the left of the engaging claws 75. Thereby, the detection member 52 is restrained from further moving rightward.

Also, as shown in FIGS. 1 and 3A, the left end portion of the detection projection 57 is arranged in the slit 71 of the gear cover 39.

Also, as shown in FIGS. 3A and 3B, a front end portion of the first gear part 45A of the agitator gear 45 is arranged in the notched portion 65A of the detection member 52.

At a state where the developing cartridge 1 is not used yet, i.e., the developing cartridge 1 is a new product, a downstream end portion of the teeth part 51A of the first toothless gear 51 in the counterclockwise direction, as seen from the left side, and a downstream end portion of the teeth part 50A of the second toothless gear 50 in the counterclockwise direction, as seen from the left side, are arranged at an interval above the front of the second gear part 45B of the agitator gear 45. A position of the first toothless gear 51 at that time is an example of the stop position. Also, a position of the second toothless gear 50 at that time is an example of the first position.

Figure 8B:
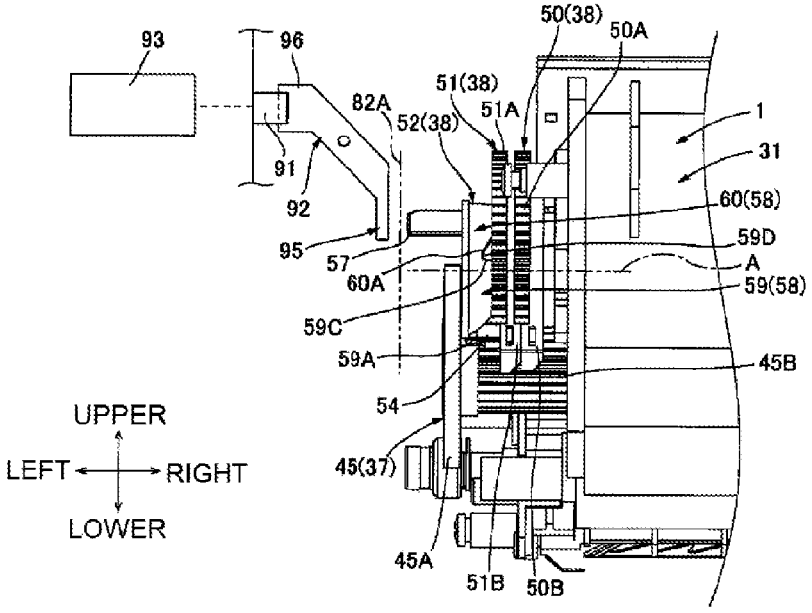
FIG. 8B is a front view of the developing cartridge shown in FIG. 8A, which illustrates a state where the detection member is located at a retreat position and an actuator is located at a non-detection position.

Also, as shown in FIGS. 8A and 8B, the first slide part 54 of the first toothless gear 51 and the second slide part 66 of the second toothless gear 50 face the rear of the first inclined surface 59A of the detection member 52 with overlapping with each other. Also, the detection member 52 is located at a retreat position at which the detection projection 57 is retreated into the gear cover 39.

4. Details of Apparatus Main Body

As shown in FIGS. 1 and 8B, the apparatus main body 12 has a main body coupling 90, an optical sensor 91, an actuator 92, and a control unit 93.

The main body coupling 90 is arranged in the apparatus main body 12 so that it is positioned at the left of the developing cartridge 1. The main body coupling 90 has a substantially cylindrical shape extending in the left-right direction. The main body coupling 90 operates in accordance with the opening and closing of the front cover 17 of the apparatus main body 12. That is, when the front cover 17 is opened, the main body coupling 90 is retreated leftward to separate from the developing cartridge 1. When the front cover 17 is closed, the main body coupling 90 is advanced rightward towards the developing cartridge 1. The main body coupling 90 has an engaging part 90A.

The engaging part 90A is arranged at a right end portion of the main body coupling 90. The engaging part 90A has a substantially cylindrical shape protruding rightward from the right end portion of the main body coupling 90. The engaging part 90A is inserted in the inner space 47B of the coupling part 47 of the developing coupling 41 in the diametrical direction, when the main body coupling 90 is advanced towards the developing cartridge 1. The engaging part 90A has a pair of engaging projections 90B.

Each of the pair of engaging projections 90B has a substantially rectangular column shape extending outward, in the diametrical direction, from each of both diametrical surfaces of the engaging part 90A, in a side view. The pair of engaging projections 90B faces the pair of protrusions 47A of the coupling part 47 when the engaging part 90A is inserted into the inner space 47B in the diametrical direction.

The optical sensor 91 is arranged in the apparatus main body 12 so that it is positioned at a left-upper side of the developing cartridge 1. The optical sensor 91 has a light emitting device and a light receiving device facing each other at an interval. The light emitting device always emits detection light towards the light receiving device. The light receiving device receives the detection light emitted from the light emitting device. The optical sensor 91 generates a light receiving signal when the light receiving device receives the detection light, and does not generate a light receiving signal when the light receiving device does not receive the detection light. The optical sensor 91 is electrically connected to the control unit 93.

The actuator 92 is arranged at the right of the optical sensor 91. The actuator 92 has a substantially rod shape extending in left-upper and right-lower directions and is rotatably supported at a predetermined part thereof in the upper-lower direction in the apparatus main body 12. The actuator 92 can be rotated to a non-detection position (see FIG. 8B) at which the detection light of the optical sensor 91 is shielded and a detection position (see FIG. 10B) at which the detection light of the optical sensor 91 is not shielded. The actuator 92 is all the time urged towards the non-detection position by an urging member (not shown). The actuator 92 has a pressed part 95 and a light shielding part 96.

The pressed part 95 is arranged at a right lower end portion of the actuator 92. The pressed part 95 has a substantially flat plate shape extending in the front-rear and upper-lower directions.

The light shielding part 96 is arranged at a left upper end portion of the actuator 92. The light shielding part 96 has a substantially flat plate shape extending in the upper-lower and left-right directions. The light shielding part 96 is positioned between the light emitting device and light receiving device of the optical sensor 91 when the actuator 92 is located at the non-detection position (see FIG. 8B), and is retreated rightward from between the light emitting device and light receiving device of the optical sensor 91 when the actuator 92 is located at the detection position (see FIG. 10B).

The control unit 93 has a circuit board having an application specific integrated circuit (ASIC) and is arranged in the apparatus main body 12. Also, the control unit 93 is configured to count the number of rotations of the developing roller 2.

5. Detection Operation

As shown in FIG. 2, when the process cartridge 13 is mounted to the apparatus main body 12 and the front cover 17 is closed, the main body coupling 90 (see FIG. 1) in the apparatus main body 12 is fitted to the developing coupling 41 (see FIG. 1) so that it cannot be relatively rotated, in accordance with the closing operation of the front cover 17.

After that, the control unit 93 starts a warm-up operation of the image forming apparatus 11.

When the warm-up operation of the image forming apparatus 11 starts, the engaging projections 90B of the main body coupling 90 are engaged with the protrusions 47A of the developing coupling 41.

Then, a driving force is input from the apparatus main body 12 to the developing coupling 41 through the main body coupling 90, and the developing coupling 41 is rotated in the clockwise direction, as seen from the left side, as shown in FIG. 3B.

Then, the developing gear 42, the supply gear 43 and the idle gear 44 are rotated in the counterclockwise direction, as seen from the left side. Thereby, the developing roller 2 and the supply roller 3 are rotated in the counterclockwise direction, as seen from the left side.

Also, when the idle gear 44 is rotated, the agitator gear 45 is rotated in the clockwise direction, as seen from the left side. Thereby, the agitator 6 is rotated in the clockwise direction, as seen from the left side.

When the agitator gear 45 is rotated, the abutting rib 45C is moved in the clockwise direction, as seen from the left side, in accordance with the rotation of the agitator gear 45, as shown in FIG. 8A. Then, the abutting rib 45C abuts on the boss 55 of the first toothless gear 51 from a rear-upper side, thereby pressing the boss 55 in a front-lower direction.

Figure 9A:
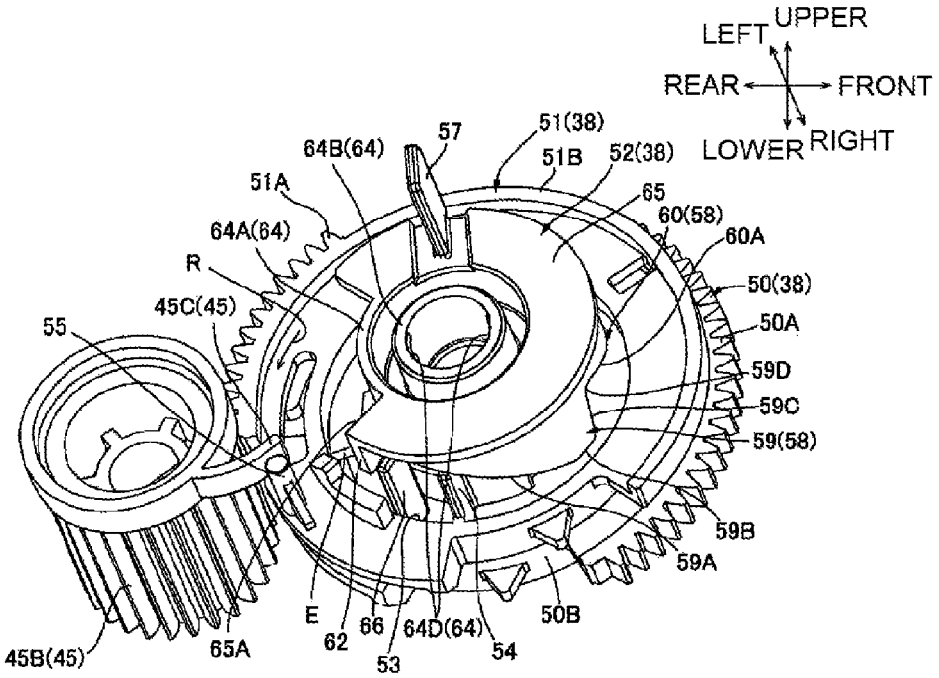
FIG. 9A illustrates the new product detection operation of the developing cartridge subsequent to FIG. 8A, which illustrates a state where a teeth part of the first toothless gear is engaged with the agitator gear.

Thereby, the first toothless gear 51 is rotated in the counterclockwise direction, as seen from the left side, and is engaged with the front upper end portion of the second gear part 45B of the agitator gear 45 at the gear teeth of the downstream end portion of the teeth part 50A in the counterclockwise direction, as seen from the left side, as shown in FIG. 9A. A position of the first toothless gear 51 at that time is an example of the driving position.

Then, the driving force is transmitted from the agitator gear 45 to the first toothless gear 51, and the first toothless gear 51 is rotated about a central axis A of the support shaft 36 in the counterclockwise direction, as seen from the left side. Hereinafter, the counterclockwise direction as seen from the left side is referred to as a rotating direction R. The central axis A of the support shaft 36 is an example of the rotational axis.

Then, the first slide part 54 of the first toothless gear 51 abuts on the first inclined surface 40A of the first displacement part 59 of the detection member 52 from an upstream side in the rotating direction R.

Here, as described above, the left end portion of the detection projection 57 is arranged in the slit 71 (see FIG. 7) of the gear cover 39. Also, the engaging projections 64D of the detection member 52 are fitted in the guide recesses 74 (see FIG. 7).

Thereby, the left end portion of the detection projection 57 abuts on the peripheral edge part of the slit 71 at a downstream side in the rotating direction R and the engaging projections 64D abut on the inner surfaces of the guide recesses 74 in the rotating direction R, so that the detection projection 57 is restrained from being further rotated in the rotating direction R.

When the first toothless gear 51 is further rotated, the first slide part 54 presses leftward the first inclined surface 59A of the first displacement part 59 with sliding along the first inclined surface 59A in the rotating direction R. Thereby, the detection member 52 is gradually moved leftward against the urging force of the compression spring 63 with the rotation thereof being restrained.

Then, the detection projection 57 is advanced leftward through the slit 71, abuts on the pressed part 95 of the actuator 92 from right, and presses leftward the pressed part 95. Thereby, the actuator 92 swings from the non-detection position in the clockwise direction, as seen from the front.

Figure 9B:
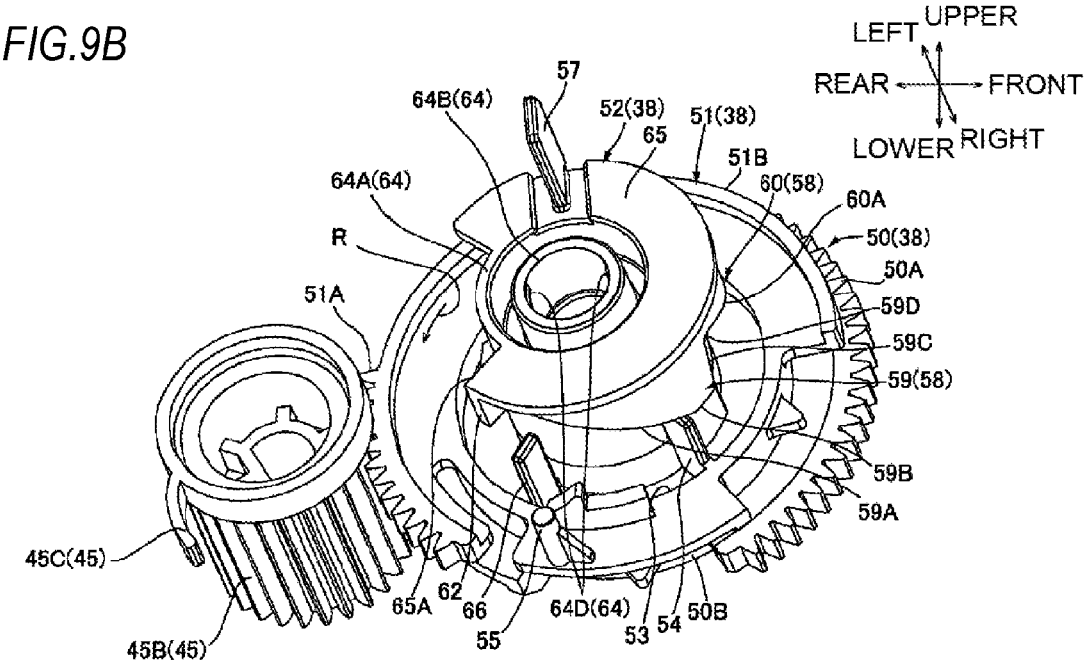
FIG. 9B illustrates the new product detection operation of the developing cartridge subsequent to FIG. 9A, which illustrates a state where a peripheral edge part of an opening of the first toothless gear abuts on a slide part of a second toothless gear.

Then, when the first toothless gear 51 is further rotated, an edge part E of an upstream end portion of the opening 53 in the rotating direction R abuts on the second slide part 66 just before the first slide part 54 abuts on the first parallel surface 59B of the first displacement part 59, as shown in FIG. 9B. The edge part E of the upstream end portion of the opening 53 in the rotating direction R is an example of the first part.

Then, the edge part E of the upstream end portion of the opening 53 in the rotating direction R presses the second slide part 66 in the rotating direction R, in accordance with the rotation of the first toothless gear 51. Thereby, the second toothless gear 50 is rotated in the rotating direction R.

Figure 10A:
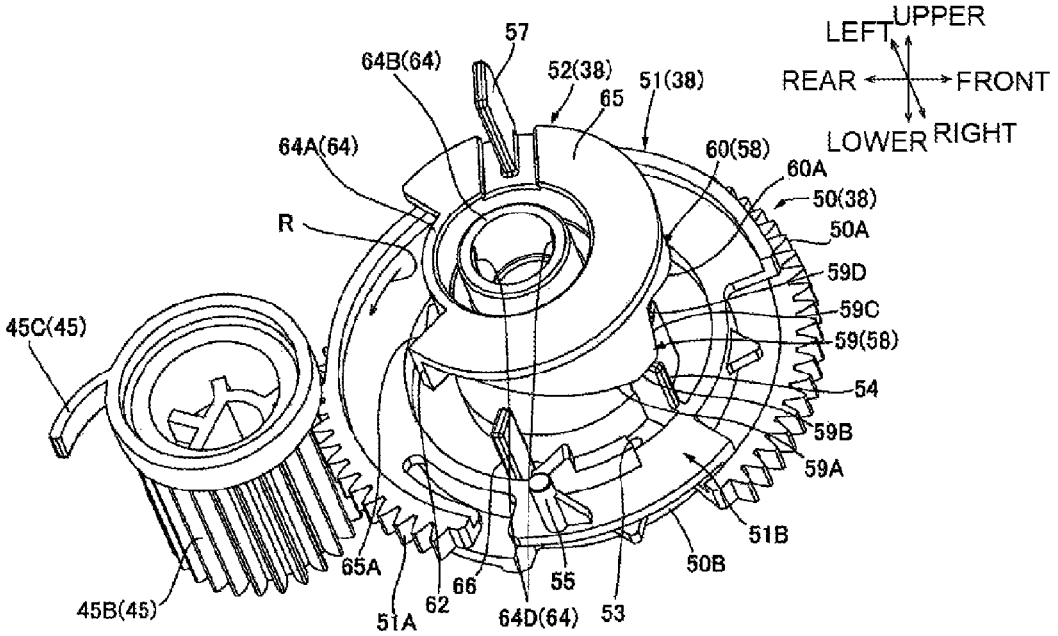
FIG. 10A illustrates the new product detection operation of the developing cartridge subsequent to FIG. 9B, which illustrates a state where a slide part of the first toothless gear abuts on a first parallel surface of a first displacement part of the detection member.
Figure 10B:
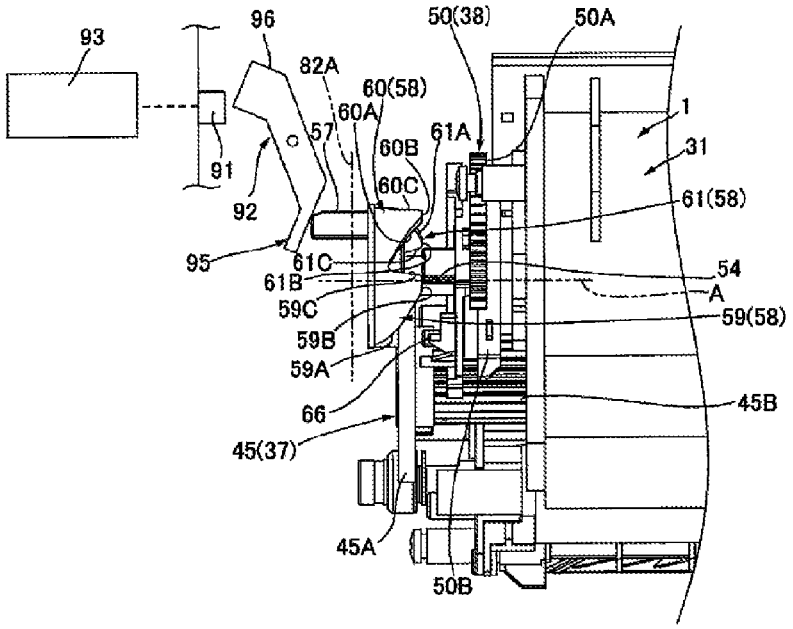
FIG. 10B is a front view of the developing cartridge shown in FIG. 10A, which illustrates a state where the detection member is located at an advance position and the actuator is located at a detection position.

Then, when the first toothless gear 51 is further rotated, the detection member 52 is located at an advance position at which the detection projection 57 is advanced most leftward when the first slide part 54 abuts on the first parallel surface 59B of the first displacement part 59, as shown in FIGS. 10A and 10B.

At this time, the actuator 92 is located at the detection position. The light shielding part 96 is retreated rightward between the light emitting device and light receiving device of the optical sensor 91. Thereby, the light receiving device of the optical sensor 91 receives the detection light, and the optical sensor 91 outputs a first light receiving signal.

Then, the control unit 93 determines that the unused developing cartridge 1 has been mounted to the apparatus main body 12, because the light receiving signal is received from the optical sensor 91 within predetermined time after the warm-up operation starts. When it is determined that the unused developing cartridge 1 has been mounted to the apparatus main body 12, the control unit 93 resets the counted number of rotations of the developing roller 2.

Then, when the toothless gear 51 is further rotated, the first slide part 54 abuts on the second inclined surface 59C of the first displacement part 59 and slides along the second inclined surface 59C in the rotating direction R. Then, the detection member 52 is gradually moved rightward by the urging force of the compression spring 63 with the rotation thereof being restrained.

Thereby, the detection projection 57 is gradually retreated into the gear cover 39 and is spaced leftward from the pressed part 95 of the actuator 92. Then, the actuator 92 swings from the detection position in the clockwise direction, as seen from the front, and is located at the non-detection position.

Thereby, the light shielding part 96 of the actuator 92 is positioned between the light emitting device and light receiving device of the optical sensor 91.

Thus, the light receiving device of the optical sensor 91 does not receive the detection light and the optical sensor 91 stops the output of the first light receiving signal.

Figure 11A:
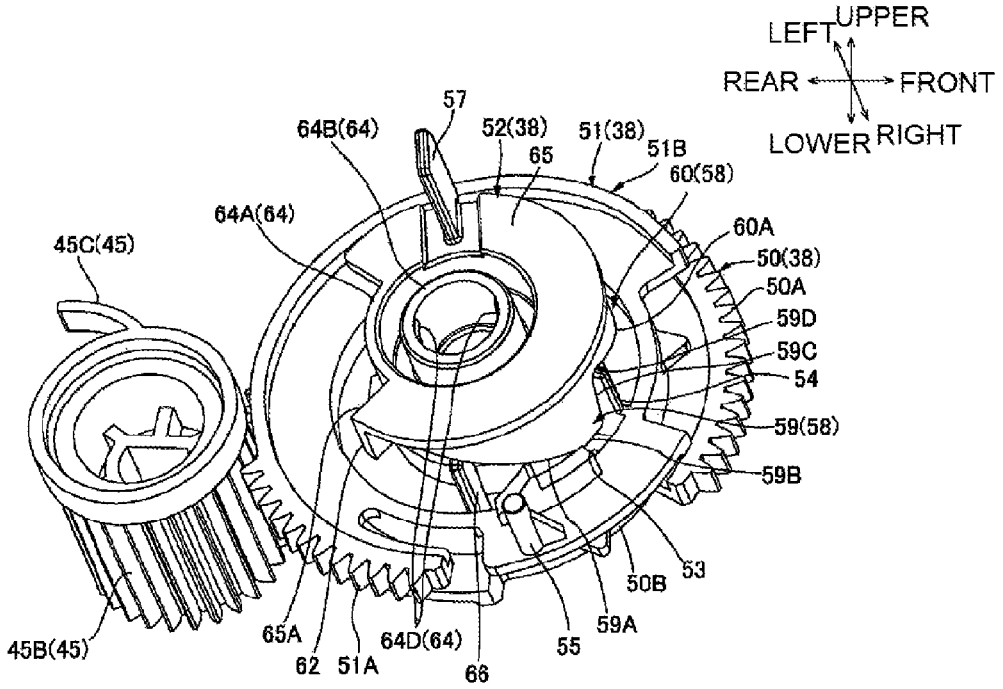
FIG. 11A illustrates the new product detection operation of the developing cartridge subsequent to FIG. 10B, which illustrates a state where a meshing between the teeth part of the first toothless gear and the agitator gear is released and the slide part of the first toothless gear abuts on a second parallel surface of the first displacement part of the detection member.
Figure 11B:
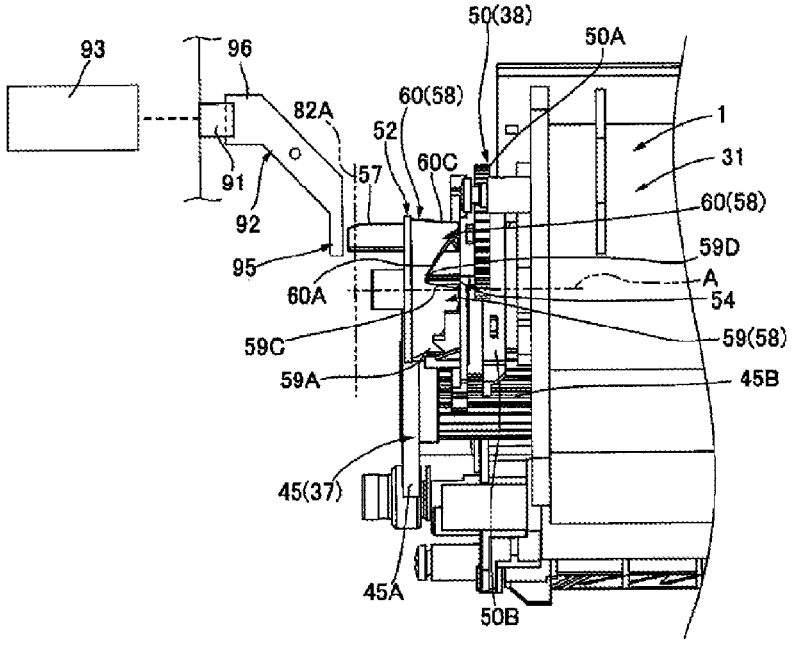
FIG. 11B is a front view of the developing cartridge shown in FIG. 11A, which illustrates a state where the detection member is located at a standby position and the actuator is located at the non-detection position.

Then, when the first toothless gear 51 is further rotated, the further movement of the detection member 52 in the leftward direction is stopped at a state where the detection projection 57 is advanced slightly more leftward than the gear cover 39 when the first slide part 54 abuts on the second parallel surface 59D of the first displacement part 59, as shown in FIG. 11A. Thereby, the first reciprocating movement of the detection member 52 is completed.

Also, at this time, the teeth part 51A of the first toothless gear 51 is spaced from the second gear part 45B of the agitator gear 45. Also, the first slide part 54 is fitted between the second inclined surface 59C of the first displacement part 59 and the first inclined surface 60A of the second displacement part 60. Thereby, the rotation of the first toothless gear 51 is stopped. That is, a recess portion defined by the second inclined surface 59C of the first displacement part 59, the second parallel surface 59D of the first displacement part 59 and the first inclined surface 60A of the second displacement part 60 is an example of the restraint part restraining the rotation of the first toothless gear 51. A rotating angle of the first toothless gear 51 corresponds to the angle θ1 (see FIG. 5) of the teeth part 51A, and is specifically 78.5°.

Also, at this time, the second toothless gear 50 is engaged with a front upper end portion of the second gear part 45B of the agitator gear 45 at the gear teeth of the downstream end portion of the teeth part 50A in the counterclockwise direction, as seen from the left side. A position of the second toothless gear 50 at that time is an example of the second position.

Then, the driving force is transmitted from the agitator gear 45 to the second toothless gear 50, and the second toothless gear 50 is rotated about the central axis A of the support shaft 36 in the rotating direction R.

Figure 12A:
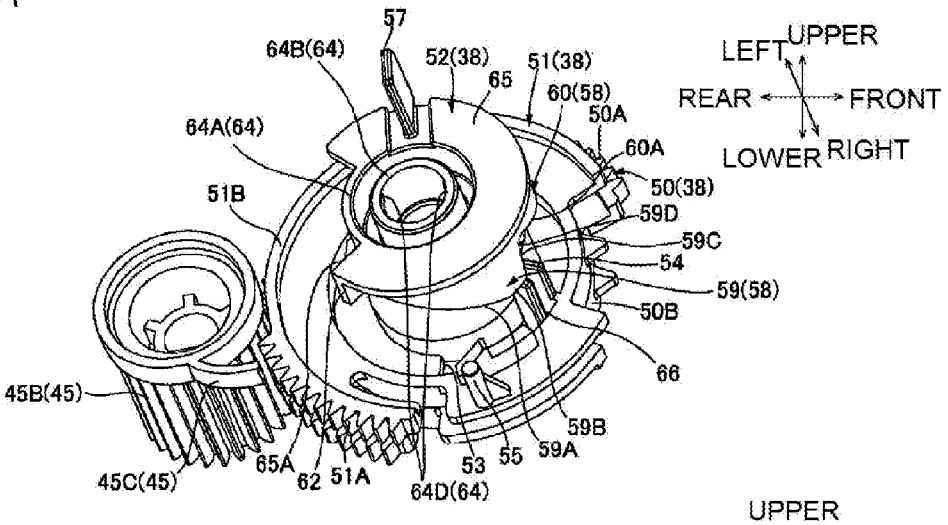
FIG. 12A illustrates the new product detection operation of the developing cartridge subsequent to FIG. 11A, which illustrates a state where a slide part of a second toothless gear abuts on the first parallel surface of the first displacement part of the detection member.

Then, when the second toothless gear 50 is further rotated, the second slide part 66 presses leftward the first inclined surface 59A of the first displacement part 59, as shown in FIG. 12A.

Thereby, the detection member 52 is located at the advance position and the actuator 92 is located at the detection position. Thereby, the optical sensor 91 outputs a second time light receiving signal.

Then, when the second toothless gear 50 is further rotated, the second slide part 66 abuts on the first slide part 54 of the first toothless gear 51 and slides along the second inclined surface 59C of the first displacement part 59 with pressing the first slide part 54 in the rotating direction R. At this time, the second slide part 66 presses the first slide part 54, so that the second toothless gear 50 and the first toothless gear 51 are rotated together.

Thereby, the detection member 52 is gradually moved leftward by the urging force of the compression spring 63 and the detection projection 57 is spaced leftward from the pressed part 95 of the actuator 92. Thereby, the actuator 92 is located at the non-detection position, and the optical sensor 91 stops the output of the second time light receiving signal.

Figure 12B:
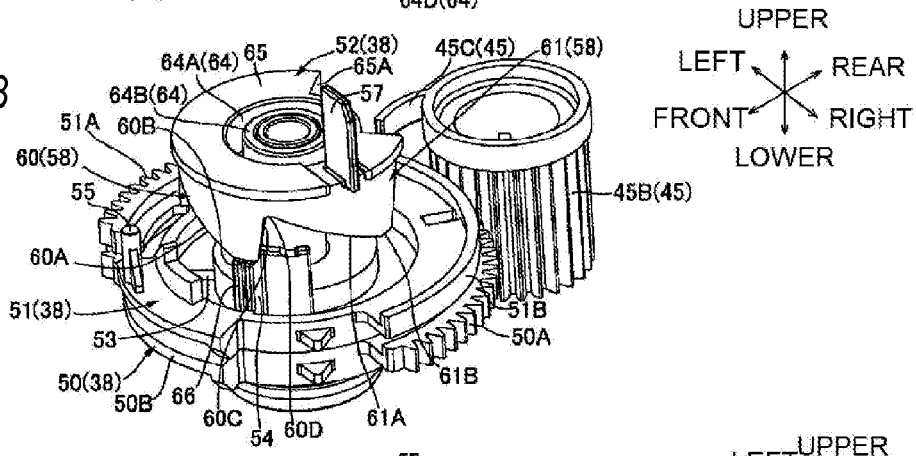
FIG. 12B illustrates the new product detection operation of the developing cartridge subsequent to FIG. 12A, which illustrates a state where the slide part of the first toothless gear and the slide part of the second toothless gear abut on a first parallel surface of a second displacement part of the detection member.

Then, when the second toothless gear 50 is further rotated, the first slide part 54 and the second slide part 66 abut on the second displacement part 60, and the detection member 52 is located at the advance position and is then retreated rightward, as shown in FIG. 12B. Thereby, the actuator 92 is located at the detection position and is then located at the non-detection position, and the optical sensor 91 outputs a third time light receiving signal and then stops the output of the third time light receiving signal.

Then, when the second toothless gear 50 is further rotated, the first slide part 54 and the second slide part 66 abut on the third displacement part 61, and the detection member 52 is located at the advance position and is then located at the retreat position. Thereby, the actuator 92 is located at the detection position and is then located at the non-detection position, and the optical sensor 91 outputs a fourth time light receiving signal and then stops the output of the fourth time light receiving signal.

Figure 12C:
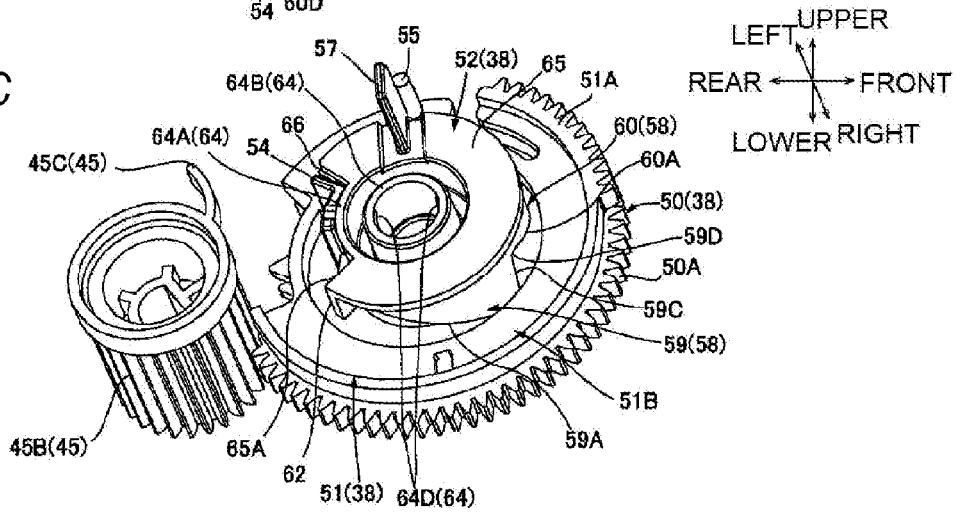
FIG. 12C illustrates the new product detection operation of the developing cartridge subsequent to FIG. 12B, which illustrates a state where a meshing between a teeth part of the second toothless gear and the agitator gear is released.

Then, when the second toothless gear 50 is further rotated, the teeth part 50A of the second toothless gear 50 is spaced from the second gear part 45B of the agitator gear 45, so that the second toothless gear 50 is stopped, as shown in FIG. 12C. At the same time, the first toothless gear 51 that is being rotated together is also stopped. A rotating angle of the second toothless gear 50 corresponds to the angle θ2 (see FIG. 5) of the teeth part 50A, and is specifically 231.1°. A total amount of the rotating angle of the first toothless gear 51 and the rotating angle of the second toothless gear 50 is 309.6°.

Thereafter, when the predetermined time elapses, the control unit 93 ends the warm-up operation.

Here, the number of receiving times of the light receiving signal, which is received from the optical sensor 91 by the control unit 93 within predetermined time after the warm-up operation starts, is associated with the specification (specifically, the maximum number of image formation sheets) of the developing cartridge 1. For example, as described above, when the light receiving signal is received four times, the control unit 93 determines that the developing cartridge 1 of a first specification (maximum number of image formation sheets: 6,000 sheets) has been mounted to the apparatus main body 12. Also, when the light receiving signal is received two times, the control unit 93 determines that the developing cartridge 1 of a second specification (maximum number of image formation sheets: 3,000 sheets) has been mounted to the apparatus main body 12.

On the other hand, when the light receiving signal is not received from the optical sensor 91 within the predetermined time after the warm-up operation starts, the control unit 93 determines that the developing cartridge 1 used or being used is mounted to the apparatus main body 12.

6. Operational Effects (1) According to the developing cartridge 1, as shown in FIG. 9B, the first toothless gear 51 is rotated by the driving force from the agitator gear 45, and then, as shown in FIG. 12A, the second toothless gear 50 is rotated by the driving force from the agitator gear 45. The detection member 52 can be moved in accordance with the rotation of the first toothless gear 51 and the second toothless gear 50 and can thus be abutted on the actuator 92.

As a result, it is possible to enable the apparatus main body 12 to recognize that the unused (new product) developing cartridge 1 has been mounted.

(2) According to the developing cartridge 1, as shown in FIGS. 10A and 11A, the peripheral edge part of the opening 53 of the first toothless gear 51 is enabled to abut on the second slide part 66 of the second toothless gear 50 by the rotation of the first toothless gear 51, so that the second toothless gear 50 abuts on the agitator gear 45. The second toothless gear 50 is rotated by the driving force from the agitator gear 45.

For this reason, it is possible to bring the second toothless gear 50 into contact with the agitator gear 45 by using the first toothless gear 51, thereby continuously rotating the first toothless gear 51 and the second toothless gear 50.

(3) According to the developing cartridge 1, it is possible to operate the developing cartridge 1 with the first toothless gear 51 being stopped after the driving force is input from the apparatus main body 12 to the developing coupling 41 until the abutting rib 45C of the agitator gear 45 abuts on the boss 55 of the first toothless gear 51, as shown in FIG. 8A.

Thereafter, the abutting rib 45C of the agitator gear 45 abuts on the boss 55 of the first toothless gear 51, so that it is possible to transmit the driving force from the agitator gear 45 to the first toothless gear 51.

Thereby, after the developing cartridge 1 operates stably, the driving force is transmitted from the agitator gear 45 to the first toothless gear 51, thereby moving the detection member 52.

As a result, it is possible to bring the detection member 52 into contact with the actuator 92 of the apparatus main body 12 while the developing cartridge 1 is stably operating.

(4) According to the developing cartridge 1, as shown in FIG. 1, in the configuration where the developing roller 2 is provided, it is possible to protect the detection member 52 and to enable the apparatus main body 12 to recognize more information.

(5) According to the developing cartridge 1, as shown in FIG. 3A, the first toothless gear 51 and the second toothless gear 50 are rotated about the same central axis A.

For this reason, it is possible to simplify the configuration, as compared to a configuration where the first toothless gear 51 and the second toothless gear 50 are rotated about different rotational axes.

(6) According to the developing cartridge 1, as shown in FIG. 3A, the first toothless gear 51 and the second toothless gear 50 are arranged to overlap with each other in the left-right direction, and the second slide part 66 of the second toothless gear 50 abuts on the displacement part 58 of the detection member 52 through the opening 53 of the first toothless gear 51.

For this reason, it is possible to effectively arrange the first toothless gear 51 and the second toothless gear 50 with overlapping in the left-right direction and to bring the second slide part 66 of the second toothless gear 50 into contact with the displacement part 58 of the detection member 52 through the opening 53 of the first toothless gear 51.

As a result, it is possible to effectively arrange the first toothless gear 51 and the second toothless gear 50 while overlapping in the left-right direction and to transmit the driving force from the second toothless gear 50 to the detection member 52 with a simple configuration.

(7) According to the developing cartridge 1, the detection member 52 is moved in accordance with the rotation of the first toothless gear 51, as shown in FIG. 9B, and is then moved in accordance with the rotation of the second toothless gear 50, as shown in FIG. 12A.

For this reason, it is possible to move the detection member 52 by both the rotation of the first toothless gear 51 and the rotation of the second toothless gear 50.

(8) According to the developing cartridge 1, as shown in FIG. 9A, the detection member 52 having the detection projection 57 is moved in the left-right direction, thereby moving the detection projection 57.

For this reason, it is possible to reliably receive the driving force from the first toothless gear 51 and the second toothless gear 50 with the entire detection member 52, thereby stably moving the detection projection 57.

(9) According to the developing cartridge 1, as shown in FIG. 9A, the detection member 52 is moved only in the left-right direction without rotating.

For this reason, as compared to a configuration where the detection member 52 is rotated, it is possible to save a moving trajectory space of the detection member 52.

(10) According to the developing cartridge 1, as shown in FIGS. 9B and 12B, as the first toothless gear 51 or the second toothless gear 50 is rotated, the first slide part 54 or second slide part 66 gradually presses leftward the first inclined surfaces 59A, 60A, 61A of the displacement part 58 of the detection member 52.

Thereby, it is possible to smoothly move the detection member 52 in the left-right direction.

(11) According to the developing cartridge 1, as shown in FIG. 11A, when the meshing between the first toothless gear 51 and the agitator gear 45 is released and the second toothless gear 50 is rotated, the first slide part 54 is fitted in the recess portion defined by the second inclined surface 59C of the first displacement part 59, the second parallel surface 59D of the first displacement part 59 and the first inclined surface 60A of the second displacement part 60.

Thereby, it is possible to restrain the first toothless gear 51 from following the rotation of the second toothless gear 50, so that it is possible to prevent the first toothless gear 51 from being again rotated during the rotation of the second toothless gear 50.

For this reason, it is possible to prevent the driving force from being transmitted from the first toothless gear 51 to the detection member 52 during the rotation of the second toothless gear 50.

As a result, it is possible to reliably transmit the driving force from the second toothless gear 50 to the detection member 52.

(12) According to the developing cartridge 1, as shown in FIG. 5, the first toothless gear 51 and the second toothless gear 50 are configured as toothless gears. Therefore, it is possible to reliably stop each of the first toothless gear 51 and the second toothless gear 50 by a predetermined driving amount.

As a result, it is possible to bring the detection projection 57 into contact with the actuator 92 of the apparatus main body 12 only within a predetermined time after the driving force is input to the developing coupling 41.

(13) According to the developing cartridge 1, as shown in FIG. 8B, when the developing cartridge 1 is not in use and the detection member 52 is not detected by the configuration of the apparatus main body 12, the detection member 52 is covered with the left wall 82A of the detection member accommodation part 82 of the gear cover 39, so that it is possible to reliably prevent an interference with a surrounding member.

(14) According to the developing cartridge 1, as shown in FIG. 3A, it is possible to reliably retreat the detection member 52 rightward by the urging force of the compression spring 63.

(15) According to the developing cartridge 1, as shown in FIGS. 4 and 7, the gear cover 39 has the support shaft 73 supporting the detection member 52, and the toner cap 34 has the support shaft 36 supporting the first toothless gear 51.

For this reason, it is possible to support the first toothless gear 51 and the detection member 52 by using the gear cover 39 and the toner cap 34 while reducing the number of components.

(16) According to the developing cartridge 1, as shown in FIG. 3B, the front end portion of the agitator gear 45 is positioned within the notched portion 65A of the detection member 52.

For this reason, it is possible to closely arrange the detection member 52 and the agitator gear 45 in the left-right direction.

As a result, it is possible to make the developing cartridge 1 small.

(17) According to the developing cartridge 1, as shown in FIG. 9A, the detection member 52 is moved only in the left-right direction without rotating. That is, the detection projection 57 is also moved only in the left-right direction without rotating.

For this reason, as compared to a configuration where the detection member 52 is rotated and the detection projection 57 is rotated in accordance with the rotation of the detection member 52, it is possible to save a moving trajectory space of the detection projection 57.

7. Modified Embodiments (1) First Modified Embodiment

In the above illustrative embodiment, the rotating angle θ1 of the first toothless gear 51 is set to 78.5°, the detection member 52 is reciprocally moved one time during the driving of the first toothless gear 51 and then the detection member 52 is reciprocally moved three times during the driving of the second toothless gear 50. However, the rotating angle of the first toothless gear 51 is not particularly limited.

Figure 13:
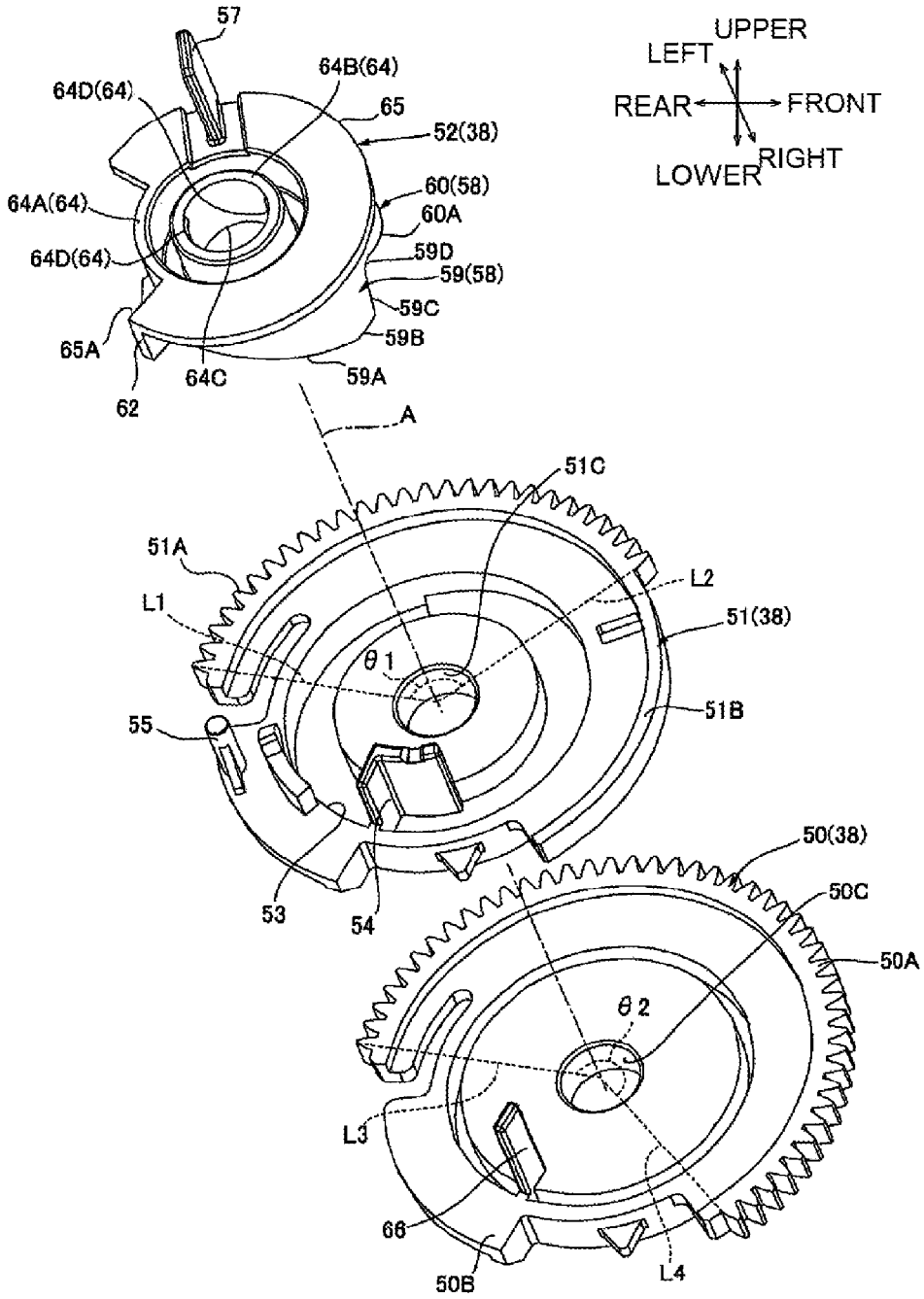
FIG. 13 is an exploded perspective view of a first modified embodiment of the developing cartridge, as seen from a left-lower side of the detection unit.
Figure 14A:
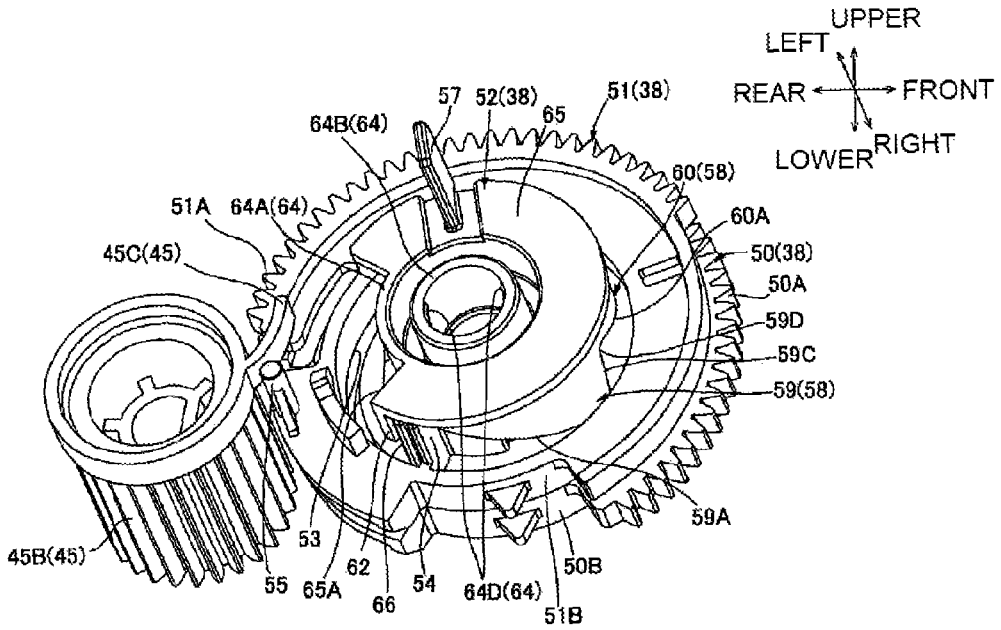
FIG. 14A illustrates a new product detection operation of the first modified embodiment, which illustrates a state where the abutting rib of the agitator gear abuts on the boss of the first toothless gear.
Figure 14B:
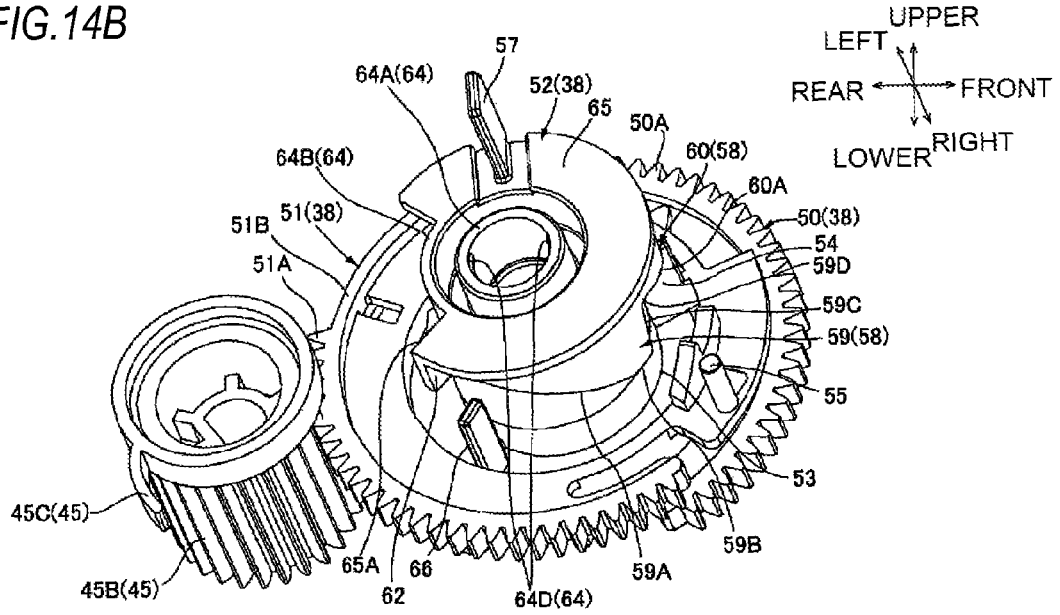
FIG. 14B illustrates the new product detection operation of the first modified embodiment subsequent to FIG. 14A, which illustrates a state where the slide part of the first toothless gear abuts on the first parallel surface of the second displacement part of the detection member.

For example, as shown in FIG. 13, the rotating angle θ1 of the first toothless gear 51 may be set to 140.4°, and the first displacement part 59 and the second displacement part 60 may be pressed by the first slide part and the detection member 52 may be reciprocally moved two times during the driving of the first toothless gear 51, as shown in FIGS. 14A and 14B.

Thereafter, like the above illustrative embodiment, the detection member 52 may be reciprocally moved three times during the driving of the second toothless gear 50, so that the detection member 52 is moved a total of five times.

In the first modified embodiment, a total amount of the rotating angle θ1 of the first toothless gear 51 and the rotating angle θ2 of the second toothless gear 50 is 360° or greater and is specifically 371.5°.

According to the first modified embodiment, a movement of the detection member 52, which is accompanied when one rotary member is rotated by one revolution or more, can be implemented by the first toothless gear 51 and the second toothless gear 50.

For this reason, it is possible to further increase the number of times of the movement, a movement distance and the like of the detection member 52 by the first toothless gear 51 and the second toothless gear 50.

Also in the first modified embodiment, it is possible to accomplish the same operational effects as the above illustrative embodiment.

(2) Second Modified Embodiment

Figure 15A:
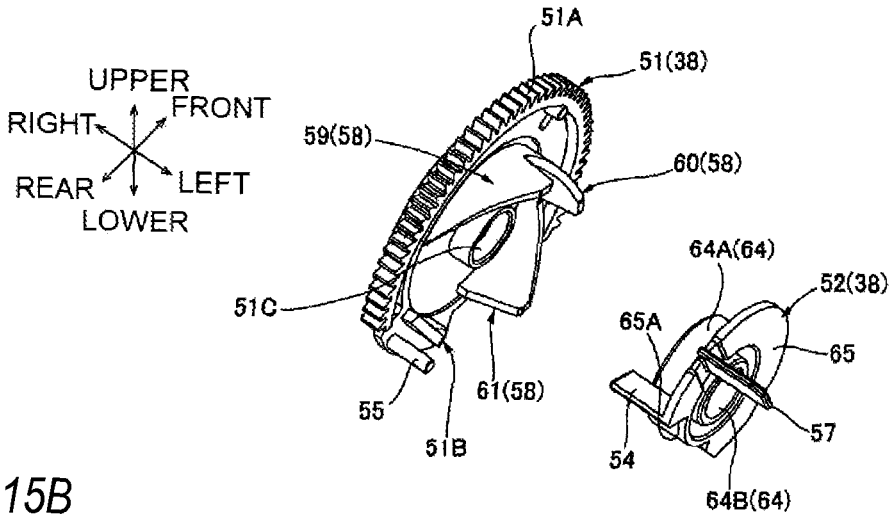
FIG. 15A illustrates a second modified embodiment of the developing cartridge.

In the above illustrative embodiment, the displacement part 58 is provided to the detection member 52, and the first slide part 54 is provided to the first toothless gear 51. However, as shown in FIG. 15A, the displacement part 58 may be provided to the first toothless gear 51, and the first slide part 54 may be provided to the detection member 52.

Also in the second modified embodiment, it is possible to accomplish the same operational effects as the above illustrative embodiment.

(3) Third Modified Embodiment

Figure 15B:
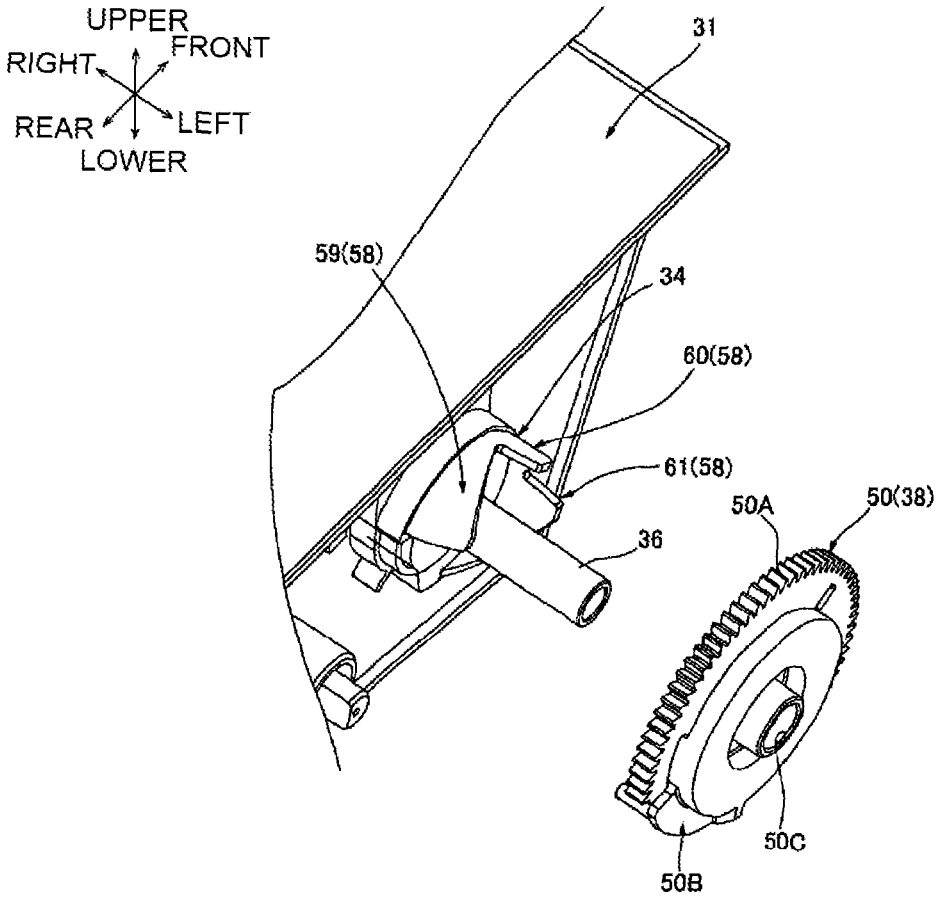
FIG. 15B illustrates a third modified embodiment of the developing cartridge.

Also, as shown in FIG. 15B, the displacement part 58 may be provided to the toner cap 34, and the first slide part 54 may be provided to the second toothless gear 50.

Also, in this case, the displacement part 58 may be provided to the developing frame 31.

Also in the third modified embodiment, it is possible to accomplish the same operational effects as the above illustrative embodiment.

(4) Fourth Modified Embodiment

Figure 16A:
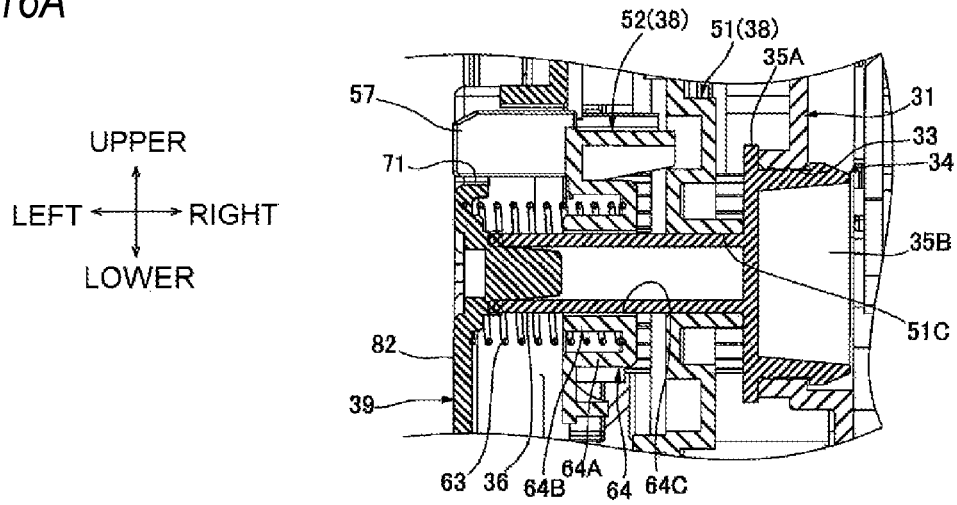
FIG. 16A illustrates a fourth modified embodiment of the developing cartridge.

In the above illustrative embodiment, the support shaft 36 of the toner cap 34 supports the first toothless gear 51 and second toothless gear 50, and the support shaft 73 of the gear cover 39 supports the detection member 52. However, as shown in FIG. 16A, the gear cover 39 may not be provided with the support shaft 73 and the support shaft 36 of the toner cap 34 may be elongated in the left-right direction to support the first toothless gear 51, the second toothless gear 50 and the detection member 52 to the support shaft 36 of the toner cap 34.

Also in the fourth modified embodiment, it is possible to accomplish the same operational effects as the above illustrative embodiment.

(5) Fifth Modified Embodiment

Figure 16B:
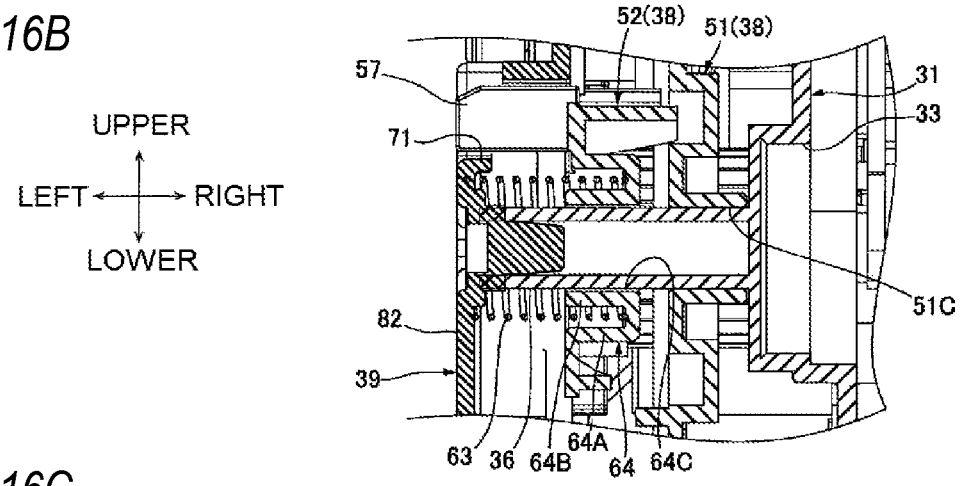
FIG. 16B illustrates a fifth modified embodiment of the developing cartridge.

In the fourth illustrative embodiment, the toner cap 34 is provided with the support shaft 36. However, as shown in FIG. 16B, the support shaft 36 may be provided on the left wall of the developing frame 31.

Also in the fifth modified embodiment, it is possible to accomplish the same operational effects as the above illustrative embodiment.

(6) Sixth Modified Embodiment

Figure 16C:
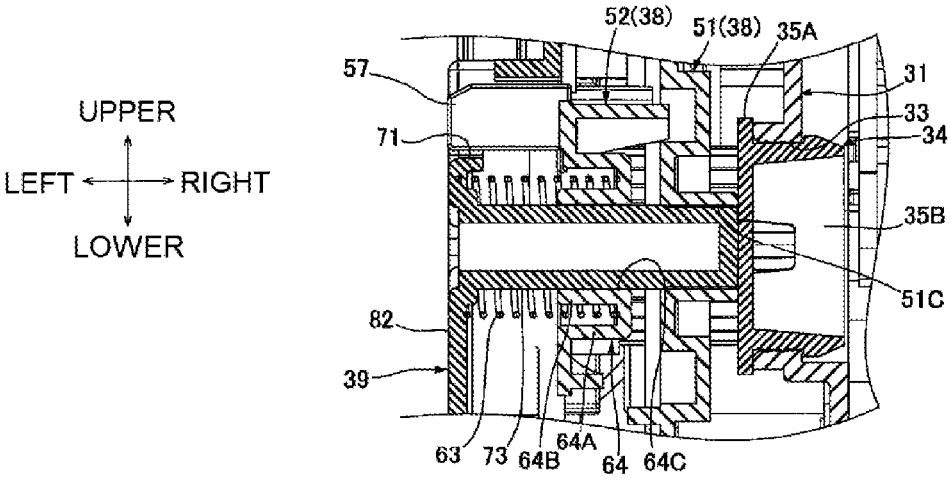
FIG. 16C illustrates a sixth modified embodiment of the developing cartridge.

Also, as shown in FIG. 16C, the toner cap 34 may not be provided with the support shaft 36 and the gear cover 39 may be configured with the support shaft 73 elongated in the left-right direction to support the first toothless gear 51, the second toothless gear 50 and the detection member 52 to the support shaft 73 of the gear cover 39.

Also, in this case, the support shaft 73 provided to the gear cover 39 may be supported by the developing frame 31, instead of the toner cap 34.

Also in the sixth modified embodiment, it is possible to accomplish the same operational effects as the above illustrative embodiment.

(7) Seventh Modified Embodiment

In the above illustrative embodiment, the first toothless gear 51 has been exemplified as the first rotary member, the second toothless gear 50 has been exemplified as the second rotary member, and the agitator gear 45 has been exemplified as the transmission member. However, the first rotary member, the second rotary member and the transmission member are not limited to the gear.

For example, the rotary members and the transmission member may be configured by friction wheels having no gear teeth.

Specifically, as shown in FIG. 17, the second gear part 45B of the agitator gear 45 may be provided with a first resistance applying member 123 of which at least an outer peripheral surface is configured by a material having a relatively large friction coefficient such as rubber, instead of the gear teeth, a transmitted part 121A of a rotary member 121 (or second rotary member) may be provided with a second resistance applying member 122 of which at least an outer peripheral surface is configured by a material having a relatively large friction coefficient such as rubber, instead of the gear teeth, and the driving force may be transmitted through friction between the resistance applying members.

Also, in this case, the second gear part 45B of the agitator gear 45 may be configured to have the gear teeth and only the transmitted part 121A of the rotary member 121 (or second rotary member) may be provided with the second resistance applying member 122 of which the outer peripheral surface is configured by the material having a relatively large friction coefficient such as rubber.

Also in the seventh modified embodiment, it is possible to accomplish the same operational effects as the above illustrative embodiment.

(8) Eighth Modified Embodiment

Figure 18A:
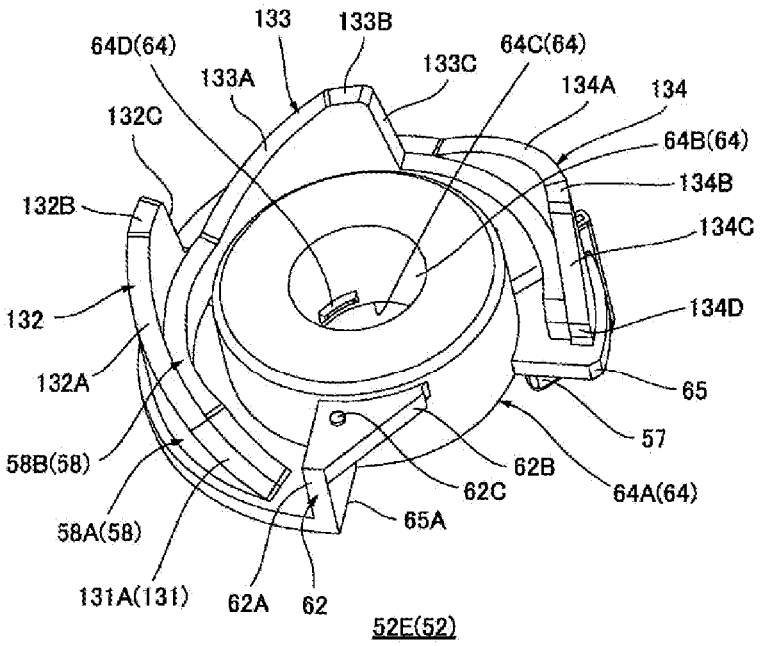
FIG. 18A is a perspective view of an eighth modified embodiment of the developing cartridge, as seen from a right-lower side.
Figure 18B:
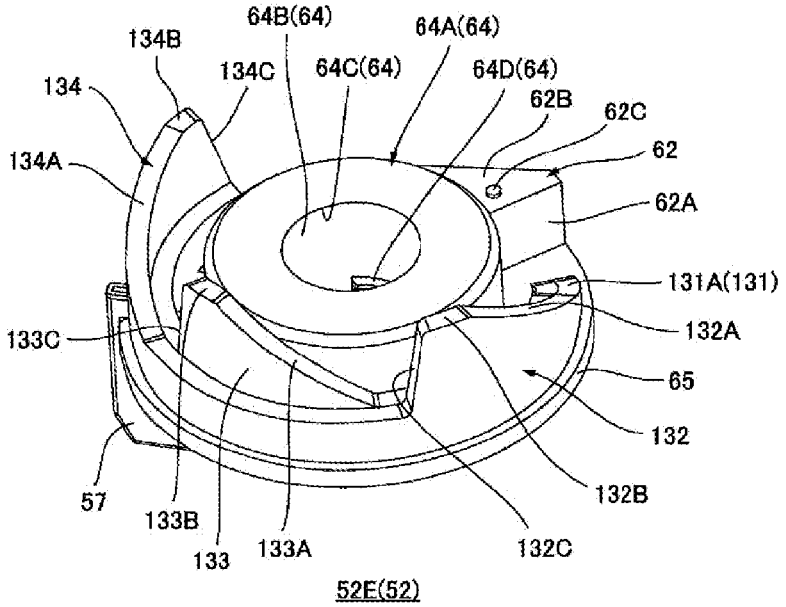
FIG. 18B is a perspective view of the eighth modified embodiment of the developing cartridge, as seen from a right-front side.

In the above illustrative embodiment, in the detection member 52, one displacement part 58 includes a plurality of displacement parts. However, for example, like a detection member 52E shown in FIGS. 18A and 18B, two displacement parts 58 may be arranged to overlap with each other in the diametrical direction of the detection member 52 and a diametrically outer-side displacement part 58A and a diametrically inner-side displacement part 58B may be provided with the displacement part, respectively. That is, the plurality of displacement parts 58 may be arranged to deviate each other in the diametrical direction of the detection member 52.

Specifically, the diametrically outer-side displacement part 58A may be provided with a first displacement part 131 and a third displacement part 132, and the diametrically inner-side displacement part 58B may be provided with a second displacement part 133.

Also in the eighth modified embodiment, it is possible to accomplish the same operational effects as the above illustrative embodiment.

(9) Other Modified Embodiments

In the above illustrative embodiment, the developing coupling 41 has been exemplified as the driving receiving part. However, the driving receiving part is not limited to the shaft coupling such as the developing coupling 41 and may be a gear, for example.

Also, in the above illustrative embodiment, the developing cartridge 1 having the developing roller 2 has been exemplified as the cartridge. However, the cartridge may be configured by a toner cartridge having only the toner accommodation part 5, without the developing roller 2 and the supply roller 3, for example.

Also, in the above illustrative embodiment, the developing roller 2 has been exemplified as the developer carrier. However, for example, a developing sleeve and the like may also be applied as the developer carrier.

Also, in the above illustrative embodiment, the first toothless gear 51 has been exemplified as the first rotary member, the second toothless gear 50 has been exemplified as the second rotary member, and the agitator gear 45 has been exemplified as the transmission member. However, the respective rotary members and the transmission member are not limited to the gear. For example, the respective rotary members and the transmission member may be configured by friction wheels having no gear teeth. Specifically, a resistance applying member of which at least an outer peripheral surface is configured by a material having a relatively large friction coefficient such as rubber may be provided, instead of the gear teeth of the agitator gear 45 and the respective toothless gears 51, 50, and the driving force may be transmitted through friction between the resistance applying members.

Also, in the above illustrative embodiment, the agitator gear 45 supported by the rotary shaft of the agitator 6 has been exemplified as the transmission member. However, the transmission member may be configured by an idle gear, which is not coupled to the rotary shaft of the agitator 6 and is supported by the left wall of the developing frame 31.

Also, in the above illustrative embodiment, the compression spring 63 has been exemplified as the urging member. However, a shape of the urging member is not limited to the coil shape, and a plate spring and the like may also be applied, for example.

Also, in the above illustrative embodiment, the detection member is once moved from the accommodation position to the standby position, is then moved to the advance position and is then reciprocally moved between the standby position and the advance position. That is, the movement distance of the detection member 52 during the second and thereafter advancing operations is shorter than the movement distance of the detection member 52 during the first advancing operation.

However, the movement distances of the detection member 52 during the respective advancing operations may be the same or may be all different.

Also, during one advancing and retreating operation, the movement distance of the detection member 52 during the advancing operation and the movement distance of the detection member 52 during the retreating operation may be the same or different.

Also, in the above illustrative embodiment, the detection projection 57 is completely accommodated in the gear cover 39 at the state where the detection member 52 is located at the accommodation position. However, the detection projection 57 may slightly protrude from the gear cover 39 at the state where the detection member 52 is located at the accommodation position.

Also, in the above illustrative embodiment, both sidewalls of the developing frame 31 in the left-right direction extend in the front-rear direction, respectively. However, at least one of both sidewalls of the developing frame 31 in the left-right direction may be inclined relative to the front-rear direction.

Also, in the above illustrative embodiment, when the light receiving signal is received four times, it is determined that the developing cartridge 1 of which the maximum number of image formation sheets is 6,000 sheets has been mounted, and when the light receiving signal is received two times, it is determined that the developing cartridge 1 of which the maximum number of image formation sheets is 3,000 sheets has been mounted. However, the relation between the number of receiving times of the light receiving signal and the maximum number of image formation sheets is not particularly limited and may be appropriately set inasmuch as the specification of the developing cartridge 1 can be distinguished.

For example, when the light receiving signal is received four times, it may be determined that the maximum number of image formation sheets is 3,000 sheets, and when the light receiving signal is received two times, it may be determined that the maximum number of image formation sheets is 6,000 sheets.

Also, the numerical values of the maximum number of image formation sheets are not limited to the above numerical values and may be appropriately set. For example, when the light receiving signal is received four times, it may be determined that the maximum number of image formation sheets is 1,000 sheets, and when the light receiving signal is received two times, it may be determined that the maximum number of image formation sheets is 2,000 sheets.

Also, in the above illustrative embodiment, the idle gear support shaft 30 is integrally provided to the developing frame 31. However, the idle gear support shaft 30 may be configured as a separate member from the developing frame 31.

Also, in the above illustrative embodiment, the support shaft (not shown) supporting the developing coupling 41 is integrally provided to the developing frame 31. However, the support shaft (not shown) supporting the developing coupling 41 may be configured as a separate member from the developing frame 31.

In the above illustrative embodiment, the control unit 93 counts the number of rotations of the developing roller 2. However, for example, the control unit 93 may count the number of rotations of the agitator 6 or to measure a remaining amount of toner in the toner accommodation part 5. In this case, the control unit 93 resets the number of rotations of the agitator 6 or the measured value of the remaining amount of toner in the toner accommodation part 5 when it is determined that an unused (new product) developing cartridge 1 has been mounted.

Also, in the above illustrative embodiment, the common detection member 52 is moved by the first toothless gear 51 and the second toothless gear 50. However, the detection member 52 moved by the first toothless gear 51 and the detection member 52 moved by the second toothless gear 50 may be separately provided.

Also, in the above illustrative embodiment, the opening 53 has a substantially rectangular shape, in a side view. However, the shape of the opening 53 is not particularly limited and may have a substantially U shape opening towards the outer side of the first toothless gear 51 in the diametrical direction, in a side view, for example.

The above illustrative embodiment and modified embodiments may be combined with each other.

The disclosure provides illustrative, non-limiting aspects as follows:

According to an aspect of the disclosure, there is provided a cartridge including a housing configured to accommodate therein developer, a driving receiving part configured to receive a driving force, a transmission member configured to rotate by receiving a driving force from the driving receiving part, a first rotary member configured to rotate by abutting on the transmission member and receiving a driving force from the transmission member, a second rotary member configured to abut on the transmission member by receiving a driving force from the first rotary member, and rotate by abutting on the transmission member and receiving a driving force from the transmission member, and a detected part configured to move in accordance with the rotation of the second rotary member.

According to the above configuration, the first rotary member is rotated by the driving force from the transmission member, and then, the second rotary member is rotated by the driving force from the transmission member. The detected part is moved in accordance with the rotation of at least the second rotary member, so that an external device can be enabled to detect the detected part.

As a result, it is possible to enable the external device to recognize that an unused cartridge has been mounted.

In the above cartridge, the first rotary member may include a first part configured to move in accordance with the rotation of the first rotary member. The second rotary member may include a second part abutting on the first part, and may be configured to move from a first position at which an abutting state with the transmission member is released to a second position at which the second rotary member abuts on the transmission member due to the first part abutting on the second part.

According to the above configuration, the first part of the first rotary member is enabled to abut on the second part of the second rotary member by the rotation of the first rotary member, so that the second rotary member abuts on the transmission member. The second rotary member is rotated by the driving force from the transmission member.

For this reason, it is possible to bring the second rotary member into contact with the transmission member by using the first rotary member, thereby continuously rotating the first rotary member and the second rotary member.

In the above cartridge, the transmission member may include a transmitting part configured to transmit the driving force to the first rotary member and the second rotary member and an engaging part provided at a position different from the transmitting part and configured to move in accordance with the rotation of the transmission member. The first rotary member may include a first transmitted part configured to abut on the transmitting part and an engaged part configured to abut on the engaging part. The first rotary member may be configured to move from a stop position at which an abutting state between the first transmitted part and the transmitting part is released to a driving position at which the first transmitted part abuts on the transmitting part due to the engaging part abutting on the engaged part.

According to the above configuration, it is possible to operate the cartridge with the first rotary member being stopped after the driving force is input from the external device to the driving receiving part and until the engaging part of the transmission member abuts on the engaged part of the first rotary member.

Thereafter, the engaging part of the transmission member abuts on the engaged part of the first rotary member, so that it is possible to transmit the driving force from the transmission member to the first rotary member.

Thereby, after the cartridge operates stably, the driving force is transmitted from the transmission member to the first rotary member, thereby moving the detected member.

As a result, it is possible to enable the external device to detect the detected part while the cartridge is stably operating.

The above cartridge may further include a developer carrier configured to carry thereon the developer.

According to the above configuration, in the configuration where the developer carrier is provided, it is possible to protect the detected part and to enable the external device to stably recognize the detected part.

In the above cartridge, a total amount of a rotating angle of the first rotary member and a rotating angle of the second rotary member may be 360° or greater.

According to the above configuration, a movement of the detected part, which is accompanied when one rotary member is rotated by one revolution or more, can be implemented by the first rotary member and the second rotary member.

For this reason, it is possible to reliably increase the number of times of the movement, a movement distance and the like of the detected part by the first rotary member and the second rotary member.

In the above cartridge, the first rotary member and the second rotary member may be configured to rotate about a same rotational axis.

According to the above configuration, it is possible to simplify the configuration, as compared to a configuration where the first rotary member and the second rotary member are rotated about different rotational axes.

In the above cartridge, the first rotary member and the second rotary member may be arranged in parallel with each other in an axis direction parallel with the rotational axis. The first rotary member may have a through-hole penetrating therethrough in the axis direction. The second rotary member may include an operating part configured to apply a force for moving the detected part in the axis direction to the detected part through the through-hole.

According to the above configuration, even when the first rotary member and the second rotary member are arranged to overlap with each other in the axis direction, it is possible to enable the operating part of the second rotary member to operate on the detected member through the through-hole of the first rotary member.

As a result, it is possible to effectively arrange the first rotary member and the second rotary member while overlapping in the axis direction and to transmit the driving force from the second rotary member to the detected member with a simple configuration.

In the above cartridge, the detected part may be configured to move in accordance with the rotation of the first rotary member, and then move in accordance with the rotation of the second rotary member.

According to the above configuration, it is possible to move the detected part by both the rotation of the first rotary member and the rotation of the second rotary member.

The above cartridge may include a detected member including the detected part. The detected member may be configured to move in an axis direction parallel with a rotational axis of the first rotary member by receiving a driving force from the first rotary member, and then move in the axis direction by receiving a driving force from the second rotary member.

According to the above configuration, it is possible to move the detected part by moving the detected member having the detected part in the axis direction.

For this reason, it is possible to reliably receive the driving force from the first rotary member and the second rotary member with the entire detected member, thereby stably moving the detected part.

In the above cartridge, the detected member may be configured to move in the axis direction while being restrained from rotating.

According to the above configuration, it is possible to move the detected part only in the axis direction.

For this reason, as compared to a configuration where the detected part is moved in accordance with the rotation of the detected member, it is possible to save a moving trajectory space of the detected part.

In the above cartridge, the first rotary member may include a first operating part configured to apply a force for moving the detected member in the axis direction to the detected member. The second rotary member may include a second operating part configured to apply a force for moving the detected member in the axis direction to the detected member. The detected member may include an abutment part configured to be abutted on by the first operating part and the second operating part. The abutment part may include an inclined part inclined in a direction from the detected member to the first rotary member towards downstream sides in rotating directions of the first rotary member and the second rotary member.

According to the above configuration, as the first rotary member or second rotary member is rotated, the first operating part or second operating part gradually presses the inclined part of the detected member in the axis direction.

Thereby, it is possible to smoothly move the detected member in the axis direction.

In the above cartridge, the detected member may include a restraint part configured to restrain the first rotary member from being further rotated after the second rotary member receives the driving force from the transmission member.

According to the above configuration, it is possible to prevent the first rotary member from being again rotated during the rotation of the second rotary member.

For this reason, it is possible to prevent the driving force from being transmitted from the first rotary member to the detected member during the rotation of the second rotary member.

As a result, it is possible to reliably transmit the driving force from the second rotary member to the detected member.

In the above cartridge, the transmission member may include a transmitting part configured to transmit the driving force to the first rotary member and the second rotary member. The first rotary member may include a first transmitted part configured to abut on the transmitting part and a first non-contact part configured to release the abutment with the transmitting part. The second rotary member may include a second transmitted part configured to abut on the transmitting part and a second non-contact part configured to release the abutment with the transmitting part.

According to the above configuration, while the first transmitted part abuts on the transmitting part, the first rotary member is rotated, and the rotation can be stopped when the first non-contact part faces the transmitting part.

Also, like the first rotary member, while the second transmitted part abuts on the transmitting part, the second rotary member is rotated, and the rotation can be stopped when the second non-contact part faces the transmitting part.

For this reason, it is possible to reliably stop the first rotary member and the second rotary member by a predetermined driving amount, respectively.

As a result, it is possible to enable the external device to detect the detected part only within a predetermined time after the driving force is input to the driving receiving part.

The above cartridge may further include a covering member including a covering part that faces the detected member from an opposite side of the housing in an axis direction parallel with a rotational axis of the first rotary member.

According to the above configuration, when the detected part is not detected by the external device, the detected member is covered with the covering part, so that it is possible to reliably prevent an interference with the external device.

The above cartridge may further include an urging member abutting on the covering part and the detected member to urge the detected member towards the housing.

According to the above configuration, it is possible to reliably retreat the detected member in a direction from the covering part towards the rotary member by the urging force of the urging member.

In the above cartridge, at least one of the covering member and the housing may include a support part that supports the detected member.

According to the above configuration, it is possible to support the detected member by using at least one of the covering member and the housing while reducing the number of components.

In the above cartridge, the support part may include a first support part provided to the covering member and a second support part provided to the housing. The detected member may be supported by the first support part. The first rotary member and the second rotary member may be supported by the second support part.

According to the above configuration, the rotary member is supported by the second support part of the housing, so that it is possible to rotate the rotary member at a position close to the housing.

Thereby, it is possible to stably rotate the rotary member.

Further, the detected member is supported by the first support part of the covering member positioned at an outer side than the housing in the axis direction.

For this reason, it is possible to stably move the detected member towards the outer side in the axis direction.

As a result, it is possible to stably move the detected member towards the outer side in the axis direction by the driving force from the rotary member being stably rotated.

In the above cartridge, the housing may include a filling port for filling the developer inside the housing, and a closing member that closes the filling port. The support part may be provided to the closing member.

According to the above configuration, it is possible to support the detected member by using the closing member closing the filling port while reducing the number of components.

In the above cartridge, the detected member may include a notched portion notched in a direction away from the transmission member. At least a portion of the transmission member may be positioned within the notched portion.

According to the above configuration, it is possible to closely arrange the detected member and the transmission member so that at least a part of the transmission member is located within the notched portion.

As a result, it is possible to make the cartridge small.

In the above cartridge, the detected part may be configured to move in an axis direction parallel with a rotational axis direction of the second rotary member while being restrained from rotating in a rotating direction of the second rotary member.

According to the above configuration, it is possible to move the detected part only in the axis direction.

For this reason, it is possible to save a moving trajectory space of the detected part, as compared to a configuration where the detected part is moved in accordance with the rotation of the detected member.

According to the cartridge of the disclosure, it is possible to enable the external device to recognize that the unused cartridge has been mounted.

What is claimed is:

1. A cartridge comprising:

a housing configured to accommodate therein developer;

a driving receiving part configured to receive a driving force;

a transmission member configured to rotate by receiving a driving force from the driving receiving part;

a first rotary member configured to rotate by abutting on the transmission member and receiving a driving force from the transmission member;

a second rotary member configured to abut on the transmission member by receiving a driving force from the first rotary member, and rotate by abutting on the transmission member and receiving a driving force from the transmission member; and a detected part configured to move in accordance with the rotation of the second rotary member, wherein the first rotary member and the second rotary member are configured to rotate about a same rotational axis.

2. The cartridge according to claim 1, wherein the first rotary member includes a first part configured to move in accordance with the rotation of the first rotary member, and wherein the second rotary member includes a second part abutting on the first part, and is configured to move from a first position at which an abutting state with the transmission member is released to a second position at which the second rotary member abuts on the transmission member due to the first part abutting on the second part.

3. The cartridge according to claim 1, wherein the transmission member includes a transmitting part configured to transmit the driving force to the first rotary member and the second rotary member and an engaging part provided at a position different from the transmitting part and configured to move in accordance with the rotation of the transmission member, wherein the first rotary member includes a first transmitted part configured to abut on the transmitting part and an engaged part configured to abut on the engaging part, and wherein the first rotary member is configured to move from a stop position at which an abutting state between the first transmitted part and the transmitting part is released to a driving position at which the first transmitted part abuts on the transmitting part due to the engaging part abutting on the engaged part.

4. The cartridge according to claim 1, further comprising:

a developer carrier configured to carry thereon the developer.

5. The cartridge according to claim 1, wherein a total amount of a rotating angle of the first rotary member and a rotating angle of the second rotary member is 360° or greater.

6. The cartridge according to claim 1, wherein the first rotary member and the second rotary member are arranged in parallel with each other in an axis direction parallel with the rotational axis, wherein the first rotary member has a through-hole penetrating therethrough in the axis direction, and wherein the second rotary member includes an operating part configured to apply a force for moving the detected part in the axis direction to the detected part through the through-hole.

7. The cartridge according to claim 1, wherein the detected part is configured to move in accordance with the rotation of the first rotary member, and then move in accordance with the rotation of the second rotary member.

8. The cartridge according to claim 7, further comprising:

a detected member including the detected part, wherein the detected member is configured to move in an axis direction parallel with a rotational axis of the first rotary member by receiving a driving force from the first rotary member, and then move in the axis direction by receiving a driving force from the second rotary member.

9. The cartridge according to claim 8, wherein the detected member is configured to move in the axis direction while being restrained from rotating.

10. The cartridge according to claim 8, wherein the first rotary member includes a first operating part configured to apply a force for moving the detected member in the axis direction to the detected member, wherein the second rotary member includes a second operating part configured to apply a force for moving the detected member in the axis direction to the detected member, wherein the detected member includes an abutment part configured to be abutted on by the first operating part and the second operating part, and wherein the abutment part includes an inclined part inclined in a direction from the detected member to the first rotary member towards downstream sides in rotating directions of the first rotary member and the second rotary member.

11. The cartridge according to claim 8, wherein the detected member includes a restraint part configured to restrain the first rotary member from being further rotated after the second rotary member receives the driving force from the transmission member.

12. The cartridge according to claim 1, wherein the transmission member includes a transmitting part configured to transmit the driving force to the first rotary member and the second rotary member, wherein the first rotary member includes a first transmitted part configured to abut on the transmitting part and a first non-contact part configured to release the abutment with the transmitting part, and wherein the second rotary member includes a second transmitted part configured to abut on the transmitting part and a second non-contact part configured to release the abutment with the transmitting part.

13. The cartridge according to claim 1, further comprising:

a detected member including the detected part, and a covering member including a covering part that faces the detected member from an opposite side of the housing in an axis direction parallel with a rotational axis of the first rotary member.

14. The cartridge according to claim 13, further comprising:

an urging member abutting on the covering part and the detected member to urge the detected member towards the housing.

15. The cartridge according to claim 13, wherein at least one of the covering member and the housing includes a support part that supports the detected member.

16. The cartridge according to claim 15, wherein the support part includes a first support part provided to the covering member and a second support part provided to the housing, wherein the detected member is supported by the first support part, and wherein the first rotary member and the second rotary member are supported by the second support part.

17. The cartridge according to claim 15, wherein the housing includes a filling port for filling the developer inside the housing, and a closing member that closes the filling port, and wherein the support part is provided to the closing member.

18. The cartridge according to claim 1, further comprising:

a detected member having the detected part, wherein the detected member includes a notched portion notched in a direction away from the transmission member, and wherein at least a portion of the transmission member is positioned within the notched portion.

19. The cartridge according to claim 1, wherein the detected part is configured to move in an axis direction parallel with a rotational axis direction of the second rotary member while being restrained from rotating in a rotating direction of the second rotary member.

20. A cartridge comprising:

a housing configured to accommodate therein developer;

a driving receiving part configured to receive a driving force;

a transmission member configured to rotate by receiving a driving force from the driving receiving part;

a first rotary member configured to rotate by abutting on the transmission member and receiving a driving force from the transmission member;

a second rotary member configured to abut on the transmission member by receiving a driving force from the first rotary member, and rotate by abutting on the transmission member and receiving a driving force from the transmission member; and a detected part configured to move in accordance with the rotation of the second rotary member, wherein the detected part is configured to move in accordance with the rotation of the first rotary member, and then move in accordance with the rotation of the second rotary member.

* * * * *